US007190380B2

(12) United States Patent
Damera-Venkata et al.

(10) Patent No.: US 7,190,380 B2
(45) Date of Patent: Mar. 13, 2007

(54) GENERATING AND DISPLAYING SPATIALLY OFFSET SUB-FRAMES

(75) Inventors: Niranjan Damera-Venkata, Mountain View, CA (US); Daniel R. Tretter, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 588 days.

(21) Appl. No.: 10/672,845

(22) Filed: Sep. 26, 2003

(65) Prior Publication Data

US 2005/0069209 A1 Mar. 31, 2005

(51) Int. Cl.
*G09G 5/02* (2006.01)

(52) U.S. Cl. ..... 345/698; 345/204; 345/205; 345/206; 358/3.13; 358/3.14; 358/3.18

(58) Field of Classification Search ..... 345/698, 345/204, 206, 55; 358/3.13, 3.14, 3.18
See application file for complete search history.

(56) References Cited

U.S. PATENT DOCUMENTS

| | | | |
|---|---|---|---|
| 4,600,274 | A | 7/1986 | Morozumi |
| 4,662,746 | A | 5/1987 | Hornbeck |
| 4,956,619 | A | 9/1990 | Hornbeck |
| 5,061,049 | A | 10/1991 | Hornbeck |
| 5,083,857 | A | 1/1992 | Hornbeck |
| 5,386,253 | A | 1/1995 | Fielding |
| 5,490,009 | A | 2/1996 | Venkateswar et al. |
| 5,689,283 | A | 11/1997 | Shirochi |
| 5,751,379 | A | 5/1998 | Markandey et al. |
| 5,842,762 | A | 12/1998 | Clarke |
| 5,897,191 | A | 4/1999 | Clarke |
| 5,905,504 | A | 5/1999 | Barkans et al. |
| 5,978,518 | A | 11/1999 | Oliyide et al. |
| 6,025,951 | A | 2/2000 | Swart et al. |
| 6,104,375 | A | 8/2000 | Lam |
| 6,141,039 | A | 10/2000 | Poetsch |
| 6,154,195 | A | 11/2000 | Young et al. |
| 6,184,969 | B1 | 2/2001 | Fergason |
| 6,219,017 | B1 | 4/2001 | Shimada et al. |

(Continued)

FOREIGN PATENT DOCUMENTS

| | | |
|---|---|---|
| EP | 1001306 A2 | 5/2000 |
| JP | 06038246 | 2/1994 |
| WO | WO0203688 | 1/2002 |

OTHER PUBLICATIONS

L.M. Chen and S. Hasagawa, "Visual Resolution Limits for Color Matrix Displays", Displays, Technologies, and Applications, vol. 13, pp. 221-226, 1992.

(Continued)

*Primary Examiner*—Richard Hjerpe
*Assistant Examiner*—Leonid Shapiro

(57) ABSTRACT

A method of displaying an image with a display device includes receiving a first set of image data for a first image. A first sub-frame and a second sub-frame corresponding to the first set of image data are generated. A bit-depth of the first and the second sub-frames is reduced based on a first set of quantization equations, thereby generating a first dithered sub-frame and a second dithered sub-frame. The method includes alternating between displaying the first dithered sub-frame in a first position and displaying the second dithered sub-frame in a second position spatially offset from the first position.

24 Claims, 20 Drawing Sheets

U.S. PATENT DOCUMENTS

| | | | | |
|---|---|---|---|---|
| 6,239,783 | B1 | 5/2001 | Hill et al. | |
| 6,243,055 | B1 | 6/2001 | Fergason | |
| 6,313,888 | B1 | 11/2001 | Tabata | |
| 6,384,816 | B1 | 5/2002 | Tabata | |
| 6,393,145 | B2 | 5/2002 | Betrisey et al. | |
| 6,657,603 | B1 | 12/2003 | Demetrescu et al. | |
| 6,711,299 | B2 * | 3/2004 | Chao et al. | 382/240 |
| 2002/0156364 | A1 | 10/2002 | Madore | |
| 2003/0020809 | A1 * | 1/2003 | Gibbon et al. | 348/51 |
| 2003/0090597 | A1 | 5/2003 | Katoh et al. | |

OTHER PUBLICATIONS

A. Yasuda et al., "FLC Wobbling for High-Resolution Projectors", Journal of the SID 5/3 1997, pp. 299-305.

T. Tokita et al., "P-108: FLC Resolution-Enhancing Device for Projection Displays", SID 02 Digest 2002, pp. 638-641.

L.M. Chen "One-Panel Projectors", pp. 221-226. Date unknown.

U.S. Appl. No. 10/213,555, filed on Aug. 7, 2002, entitled "Image Display System and Method".

U.S. Appl. No. 10/242,195, filed on Sep. 11, 2002, entitled "Image Display System and Method".

U.S. Appl. No. 10/242,545, filed on Sep. 11, 2002, entitled "Image Display System and Method".

U.S. Appl. No. 10/631,681, filed on Jul. 31, 2003, entitled Generating and Displaying Spatially Offset Sub-Frames.

U.S. Appl. No. 10/632,042, filed on Jul. 31, 2003, entitled Generating and Displaying Spatially Offset Sub-Frames.

R.J. Gove, "DMD Display Systems: The Impact of an All-Digital Display," Society for Information Display International Symposium, (Jun. 1994).

* cited by examiner

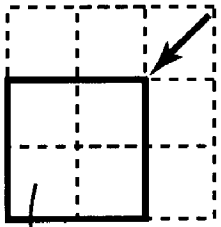
Fig. 4A
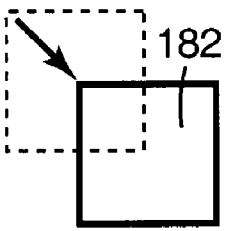
Fig. 4B
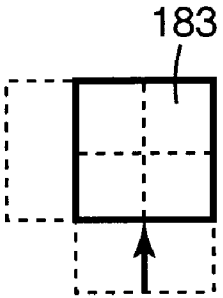
Fig. 4C
Fig. 4D
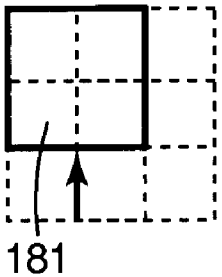
Fig. 4E (NEAREST NEIGHBOR)

GENERATING AND DISPLAYING SPATIALLY OFFSET SUB-FRAMES

CROSS-REFERENCE TO RELATED APPLICATIONS

This application is related to U.S. patent application Ser. No. 10/213,555, filed on Aug. 7, 2002, entitled IMAGE DISPLAY SYSTEM AND METHOD; U.S. patent application Ser. No. 10/242,195, filed on Sep. 11, 2002, entitled IMAGE DISPLAY SYSTEM AND METHOD; U.S. patent application Ser. No. 10/242,545, filed on Sep. 11, 2002, entitled IMAGE DISPLAY SYSTEM AND METHOD; U.S. patent application Ser. No. 10/631,681, filed on Jul. 31, 2003, entitled GENERATING AND DISPLAYING SPATIALLY OFFSET SUB-FRAMES; U.S. patent application Ser. No. 10/632,042, filed on Jul. 31, 2003, entitled GENERATING AND DISPLAYING SPATIALLY OFFSET SUB-FRAMES; and U.S. patent application Ser. No. 10/672,544, filed on the same date as the present application, entitled GENERATING AND DISPLAYING SPATIALLY OFFSET SUB-FRAMES. Each of the above U.S. Patent Applications is assigned to the assignee of the present invention, and is hereby incorporated by reference herein.

FIELD OF THE INVENTION

The present invention generally relates to display systems, and more particularly to generating and displaying spatially offset sub-frames.

BACKGROUND OF THE INVENTION

A conventional system or device for displaying an image, such as a display, projector, or other imaging system, produces a displayed image by addressing an array of individual picture elements or pixels arranged in a pattern, such as in horizontal rows and vertical columns, a diamond grid, or other pattern. A resolution of the displayed image for a pixel pattern with horizontal rows and vertical columns is defined as the number of horizontal rows and vertical columns of individual pixels forming the displayed image. The resolution of the displayed image is affected by a resolution of the display device itself as well as a resolution of the image data processed by the display device and used to produce the displayed image.

Typically, to increase a resolution of the displayed image, the resolution of the display device as well as the resolution of the image data used to produce the displayed image must be increased. Increasing a resolution of the display device, however, increases a cost and complexity of the display device. In addition, higher resolution image data may not be available or may be difficult to generate.

SUMMARY OF THE INVENTION

One form of the present invention provides a method of displaying an image with a display device, including receiving a first set of image data for a first image. A first sub-frame and a second sub-frame corresponding to the first set of image data are generated. A bit-depth of the first and the second sub-frames is reduced based on a first set of quantization equations, thereby generating a first dithered sub-frame and a second dithered sub-frame. The method includes alternating between displaying the first dithered sub-frame in a first position and displaying the second dithered sub-frame in a second position spatially offset from the first position.

BRIEF DESCRIPTION OF THE DRAWINGS

FIGS. 4A–4E are schematic diagrams illustrating the display of a pixel with an image display system according to one embodiment of the present invention.

DETAILED DESCRIPTION OF THE PREFERRED EMBODIMENTS

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

I. Spatial and Temporal Shifting of Sub-frames

Some display systems, such as some digital light projectors, may not have sufficient resolution to display some high resolution images. Such systems can be configured to give the appearance to the human eye of higher resolution images by displaying spatially and temporally shifted lower resolution images. The lower resolution images are referred to as sub-frames. A problem of sub-frame generation, which is addressed by embodiments of the present invention, is to determine appropriate values for the sub-frames so that the displayed sub-frames are close in appearance to how the high-resolution image from which the sub-frames were derived would appear if directly displayed.

One embodiment of a display system that provides the appearance of enhanced resolution through temporal and spatial shifting of sub-frames is described in the above-cited U.S. patent applications, which are incorporated by reference, and is also summarized below with reference to FIGS. 1–4E.

Figure 1:
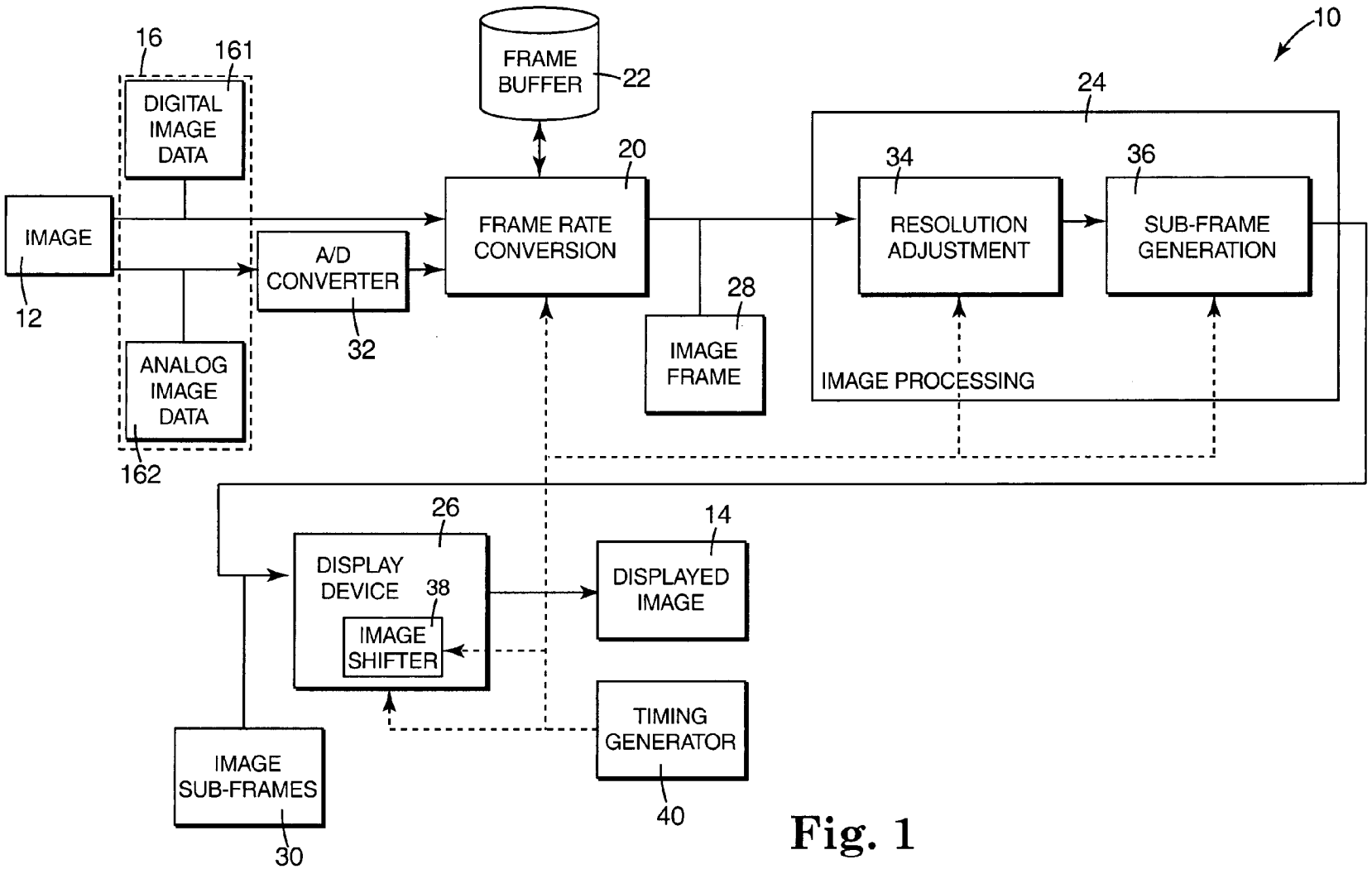
FIG. 1 is a block diagram illustrating an image display system according to one embodiment of the present invention.

FIG. 1 is a block diagram illustrating an image display system 10 according to one embodiment of the present invention. Image display system 10 facilitates processing of an image 12 to create a displayed image 14. Image 12 is defined to include any pictorial, graphical, or textural characters, symbols, illustrations, or other representation of information. Image 12 is represented, for example, by image data 16. Image data 16 includes individual picture elements or pixels of image 12. While one image is illustrated and described as being processed by image display system 10, it is understood that a plurality or series of images may be processed and displayed by image display system 10.

In one embodiment, image display system 10 includes a frame rate conversion unit 20 and an image frame buffer 22, an image processing unit 24, and a display device 26. As described below, frame rate conversion unit 20 and image frame buffer 22 receive and buffer image data 16 for image 12 to create an image frame 28 for image 12. Image processing unit 24 processes image frame 28 to define one or more image sub-frames 30 for image frame 28, and display device 26 temporally and spatially displays image sub-frames 30 to produce displayed image 14.

Image display system 10, including frame rate conversion unit 20 and image processing unit 24, includes hardware, software, firmware, or a combination of these. In one embodiment, one or more components of image display system 10, including frame rate conversion unit 20 and image processing unit 24, are included in a computer, computer server, or other microprocessor-based system capable of performing a sequence of logic operations. In addition, processing can be distributed throughout the system with individual portions being implemented in separate system components.

Image data 16 may include digital image data 161 or analog image data 162. To process analog image data 162, image display system 10 includes an analog-to-digital (A/D) converter 32. As such, A/D converter 32 converts analog image data 162 to digital form for subsequent processing. Thus, image display system 10 may receive and process digital image data 161 or analog image data 162 for image 12.

Frame rate conversion unit 20 receives image data 16 for image 12 and buffers or stores image data 16 in image frame buffer 22. More specifically, frame rate conversion unit 20 receives image data 16 representing individual lines or fields of image 12 and buffers image data 16 in image frame buffer 22 to create image frame 28 for image 12. Image frame buffer 22 buffers image data 16 by receiving and storing all of the image data for image frame 28, and frame rate conversion unit 20 creates image frame 28 by subsequently retrieving or extracting all of the image data for image frame 28 from image frame buffer 22. As such, image frame 28 is defined to include a plurality of individual lines or fields of image data 16 representing an entirety of image 12. Thus, image frame 28 includes a plurality of columns and a plurality of rows of individual pixels representing image 12.

Frame rate conversion unit 20 and image frame buffer 22 can receive and process image data 16 as progressive image data or interlaced image data. With progressive image data, frame rate conversion unit 20 and image frame buffer 22 receive and store sequential fields of image data 16 for image 12. Thus, frame rate conversion unit 20 creates image frame 28 by retrieving the sequential fields of image data 16 for image 12. With interlaced image data, frame rate conversion unit 20 and image frame buffer 22 receive and store odd fields and even fields of image data 16 for image 12. For example, all of the odd fields of image data 16 are received and stored and all of the even fields of image data 16 are received and stored. As such, frame rate conversion unit 20 de-interlaces image data 16 and creates image frame 28 by retrieving the odd and even fields of image data 16 for image 12.

Image frame buffer 22 includes memory for storing image data 16 for one or more image frames 28 of respective images 12. Thus, image frame buffer 22 constitutes a database of one or more image frames 28. Examples of image frame buffer 22 include non-volatile memory (e.g., a hard disk drive or other persistent storage device) and may include volatile memory (e.g., random access memory (RAM)).

By receiving image data 16 at frame rate conversion unit 20 and buffering image data 16 with image frame buffer 22, input timing of image data 16 can be decoupled from a timing requirement of display device 26. More specifically, since image data 16 for image frame 28 is received and stored by image frame buffer 22, image data 16 can be received as input at any rate. As such, the frame rate of image frame 28 can be converted to the timing requirement of display device 26. Thus, image data 16 for image frame 28 can be extracted from image frame buffer 22 at a frame rate of display device 26.

In one embodiment, image processing unit 24 includes a resolution adjustment unit 34 and a sub-frame generation unit 36. As described below, resolution adjustment unit 34 receives image data 16 for image frame 28 and adjusts a resolution of image data 16 for display on display device 26, and sub-frame generation unit 36 generates a plurality of image sub-frames 30 for image frame 28. More specifically, image processing unit 24 receives image data 16 for image frame 28 at an original resolution and processes image data 16 to increase, decrease, or leave unaltered the resolution of image data 16. Accordingly, with image processing unit 24, image display system 10 can receive and display image data 16 of varying resolutions.

Sub-frame generation unit 36 receives and processes image data 16 for image frame 28 to define a plurality of image sub-frames 30 for image frame 28. If resolution adjustment unit 34 has adjusted the resolution of image data 16, sub-frame generation unit 36 receives image data 16 at the adjusted resolution. The adjusted resolution of image data 16 may be increased, decreased, or the same as the original resolution of image data 16 for image frame 28. Sub-frame generation unit 36 generates image sub-frames 30 with a resolution which matches the resolution of display device 26. Image sub-frames 30 are each of an area equal to image frame 28. Sub-frames 30 each include a plurality of columns and a plurality of rows of individual pixels representing a subset of image data 16 of image 12, and have a resolution that matches the resolution of display device 26.

Each image sub-frame 30 includes a matrix or array of pixels for image frame 28. Image sub-frames 30 are spatially offset from each other such that each image sub-frame 30 includes different pixels or portions of pixels. As such, image sub-frames 30 are offset from each other by a vertical distance and/or a horizontal distance, as described below.

Display device 26 receives image sub-frames 30 from image processing unit 24 and sequentially displays image sub-frames 30 to create displayed image 14. More specifically, as image sub-frames 30 are spatially offset from each other, display device 26 displays image sub-frames 30 in different positions according to the spatial offset of image sub-frames 30, as described below. As such, display device 26 alternates between displaying image sub-frames 30 for image frame 28 to create displayed image 14. Accordingly, display device 26 displays an entire sub-frame 30 for image frame 28 at one time.

In one embodiment, display device 26 performs one cycle of displaying image sub-frames 30 for each image frame 28. Display device 26 displays image sub-frames 30 so as to be spatially and temporally offset from each other. In one embodiment, display device 26 optically steers image sub-frames 30 to create displayed image 14. As such, individual pixels of display device 26 are addressed to multiple locations.

In one embodiment, display device 26 includes an image shifter 38. Image shifter 38 spatially alters or offsets the position of image sub-frames 30 as displayed by display device 26. More specifically, image shifter 38 varies the position of display of image sub-frames 30, as described below, to produce displayed image 14.

In one embodiment, display device 26 includes a light modulator for modulation of incident light. The light modulator includes, for example, a plurality of micro-mirror devices arranged to form an array of micro-mirror devices. As such, each micro-mirror device constitutes one cell or pixel of display device 26. Display device 26 may form part of a display, projector, or other imaging system.

In one embodiment, image display system 10 includes a timing generator 40. Timing generator 40 communicates, for example, with frame rate conversion unit 20, image processing unit 24, including resolution adjustment unit 34 and sub-frame generation unit 36, and display device 26, including image shifter 38. As such, timing generator 40 synchronizes buffering and conversion of image data 16 to create image frame 28, processing of image frame 28 to adjust the resolution of image data 16 and generate image sub-frames 30, and positioning and displaying of image sub-frames 30 to produce displayed image 14. Accordingly, timing generator 40 controls timing of image display system 10 such that entire sub-frames of image 12 are temporally and spatially displayed by display device 26 as displayed image 14.

Figure 2C:
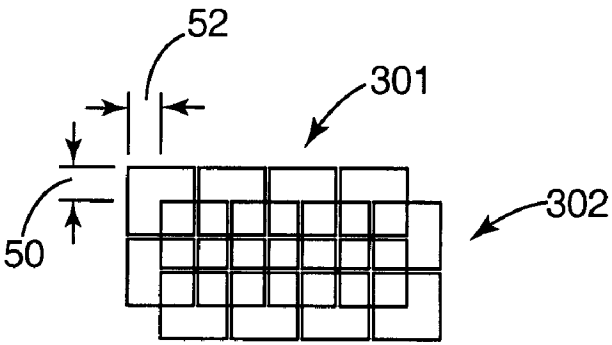
FIGS. 2A–2C are schematic diagrams illustrating the display of two sub-frames according to one embodiment of the present invention.
Figure 2B:
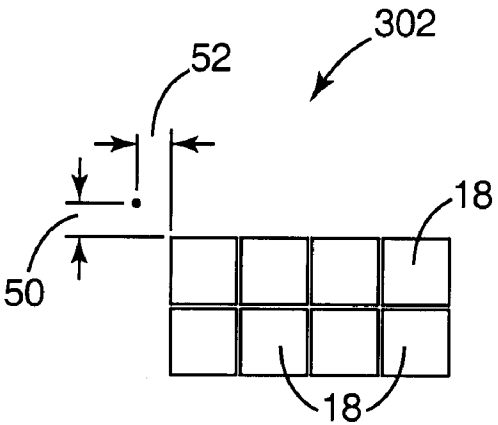
Figure 2A:
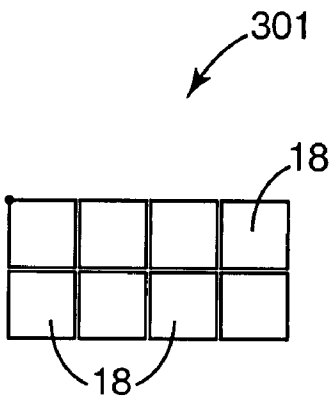

In one embodiment, as illustrated in FIGS. 2A and 2B, image processing unit 24 defines two image sub-frames 30 for image frame 28. More specifically, image processing unit 24 defines a first sub-frame 301 and a second sub-frame 302 for image frame 28. As such, first sub-frame 301 and second sub-frame 302 each include a plurality of columns and a plurality of rows of individual pixels 18 of image data 16. Thus, first sub-frame 301 and second sub-frame 302 each constitute an image data array or pixel matrix of a subset of image data 16.

In one embodiment, as illustrated in FIG. 2B, second sub-frame 302 is offset from first sub-frame 301 by a vertical distance 50 and a horizontal distance 52. As such, second sub-frame 302 is spatially offset from first sub-frame 301 by a predetermined distance. In one illustrative embodiment, vertical distance 50 and horizontal distance 52 are each approximately one-half of one pixel.

As illustrated in FIG. 2C, display device 26 alternates between displaying first sub-frame 301 in a first position and displaying second sub-frame 302 in a second position spatially offset from the first position. More specifically, display device 26 shifts display of second sub-frame 302 relative to display of first sub-frame 301 by vertical distance 50 and horizontal distance 52. As such, pixels of first sub-frame 301 overlap pixels of second sub-frame 302. In one embodiment, display device 26 performs one cycle of displaying first sub-frame 301 in the first position and displaying second sub-frame 302 in the second position for image frame 28. Thus, second sub-frame 302 is spatially and temporally displayed relative to first sub-frame 301. The display of two temporally and spatially shifted sub-frames in this manner is referred to herein as two-position processing.

In another embodiment, as illustrated in FIGS. 3A–3D, image processing unit 24 defines four image sub-frames 30 for image frame 28. More specifically, image processing unit 24 defines a first sub-frame 301, a second sub-frame 302, a third sub-frame 303, and a fourth sub-frame 304 for image frame 28. As such, first sub-frame 301, second sub-frame 302, third sub-frame 303, and fourth sub-frame 304 each include a plurality of columns and a plurality of rows of individual pixels 18 of image data 16.

Figure 3A:
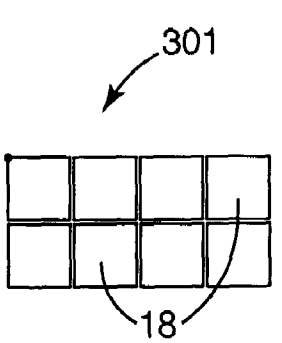
FIGS. 3A–3E are schematic diagrams illustrating the display of four sub-frames according to one embodiment of the present invention.
Figure 3B:
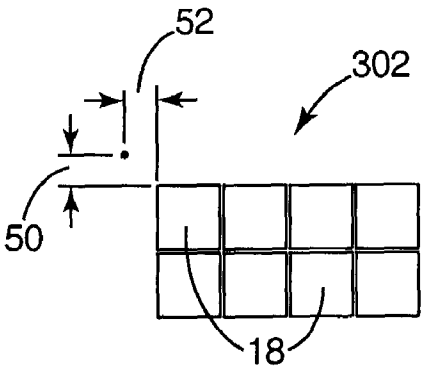
Figure 3C:
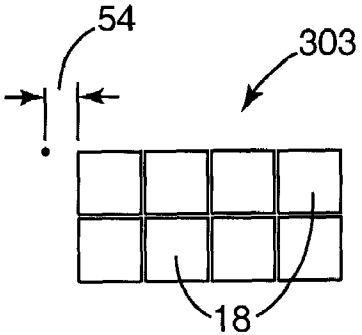
Figure 3D:
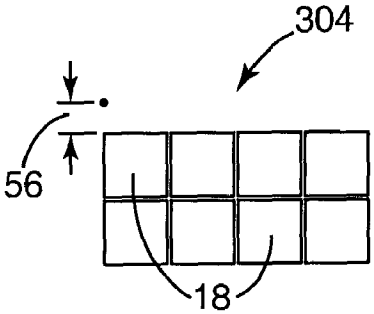

In one embodiment, as illustrated in FIGS. 3B–3D, second sub-frame 302 is offset from first sub-frame 301 by a vertical distance 50 and a horizontal distance 52, third sub-frame 303 is offset from first sub-frame 301 by a horizontal distance 54, and fourth sub-frame 304 is offset from first sub-frame 301 by a vertical distance 56. As such, second sub-frame 302, third sub-frame 303, and fourth sub-frame 304 are each spatially offset from each other and spatially offset from first sub-frame 301 by a predetermined distance. In one illustrative embodiment, vertical distance 50, horizontal distance 52, horizontal distance 54, and vertical distance 56 are each approximately one-half of one pixel.

Figure 3E:
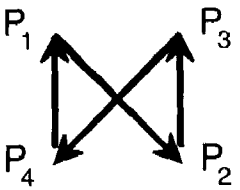

As illustrated schematically in FIG. 3E, display device 26 alternates between displaying first sub-frame 301 in a first position $P_1$, displaying second sub-frame 302 in a second position $P_2$ spatially offset from the first position, displaying third sub-frame 303 in a third position $P_3$ spatially offset from the first position, and displaying fourth sub-frame 304 in a fourth position $P_4$ spatially offset from the first position. More specifically, display device 26 shifts display of second sub-frame 302, third sub-frame 303, and fourth sub-frame 304 relative to first sub-frame 301 by the respective predetermined distance. As such, pixels of first sub-frame 301, second sub-frame 302, third sub-frame 303, and fourth sub-frame 304 overlap each other.

In one embodiment, display device 26 performs one cycle of displaying first sub-frame 301 in the first position, displaying second sub-frame 302 in the second position, displaying third sub-frame 303 in the third position, and displaying fourth sub-frame 304 in the fourth position for image frame 28. Thus, second sub-frame 302, third sub-frame 303, and fourth sub-frame 304 are spatially and temporally displayed relative to each other and relative to first sub-frame 301. The display of four temporally and spatially shifted sub-frames in this manner is referred to herein as four-position processing.

FIGS. 4A–4E illustrate one embodiment of completing one cycle of displaying a pixel 181 from first sub-frame 301 in the first position, displaying a pixel 182 from second sub-frame 302 in the second position, displaying a pixel 183 from third sub-frame 303 in the third position, and displaying a pixel 184 from fourth sub-frame 304 in the fourth position. More specifically, FIG. 4A illustrates display of pixel 181 from first sub-frame 301 in the first position, FIG. 4B illustrates display of pixel 182 from second sub-frame 302 in the second position (with the first position being illustrated by dashed lines), FIG. 4C illustrates display of pixel 183 from third sub-frame 303 in the third position (with the first position and the second position being illustrated by dashed lines), FIG. 4D illustrates display of pixel 184 from fourth sub-frame 304 in the fourth position (with the first position, the second position, and the third position being illustrated by dashed lines), and FIG. 4E illustrates display of pixel 181 from first sub-frame 301 in the first position (with the second position, the third position, and the fourth position being illustrated by dashed lines).

II. Bit-depth of Sub-Frames

In one form of the invention, image display system 10 (FIG. 1) uses pulse width modulation (PWM) to generate light pulses of varying widths that are integrated over time to produce varying gray tones, and image shifter 38 (FIG. 1) includes a discrete micro-mirror device (DMD) array to produce sub-pixel shifting of displayed sub-frames 30 during a frame time. In one embodiment, as will be described in further detail below, the time slot for one frame (i.e., frame time or frame time slot) is divided among three colors (e.g., red, green, and blue) using a color wheel. The time slot available for a color per frame (i.e., color time slot) and the switching speed of the DMD array determines the number of levels, and hence the number of bits of grayscale, obtainable per color for each frame. With two-position processing and four-position processing, which are described above with reference to FIGS. 1–4E, the time slots are further divided up into spatial positions of the DMD array. This means that the number of bits per position for two-position and four-position processing is less than the number of bits when such processing is not used. The greater the number of positions per frame, the greater the spatial resolution of the projected image. However, the greater the number of positions per frame, the smaller the number of bits per position, which can lead to contouring artifacts. The loss in bit-depth typically associated with two position processing and four position processing is described in further detail below with reference to FIGS. 5–8.

Figure 5:
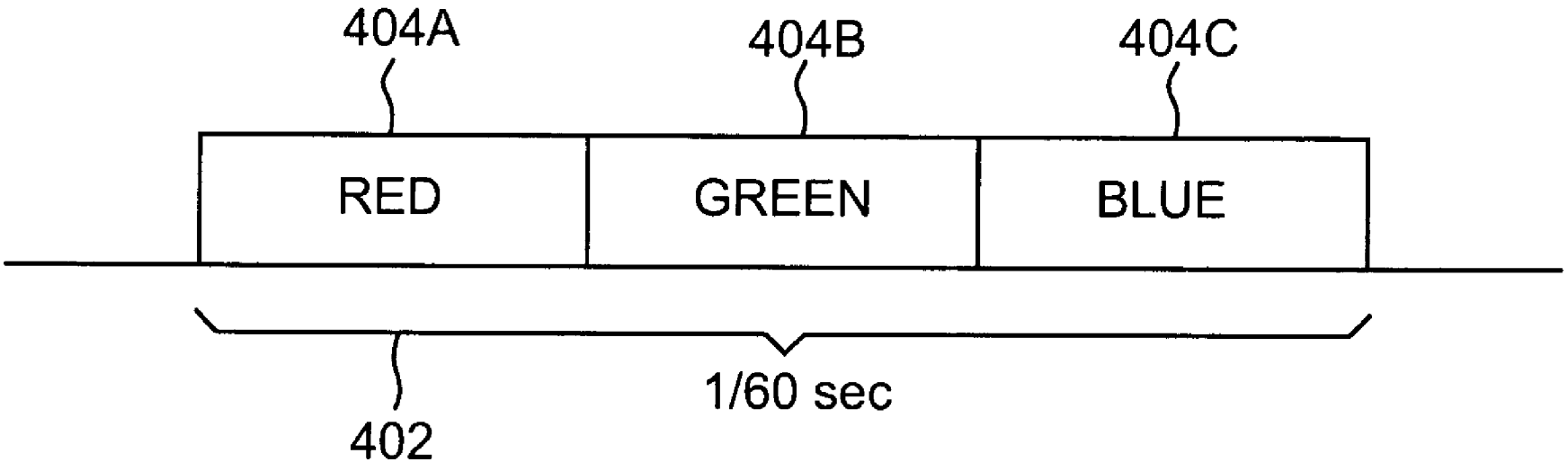
FIG. 5 is a diagram illustrating a frame time slot according to one embodiment of the present invention.

FIG. 5 is a diagram illustrating a frame time slot 402 according to one embodiment of the present invention. In the illustrated embodiment, the frame time slot 402 is $1/60^{th}$ of a second in length. Frame time slot 402 includes three color time slots 404A–404C (collectively referred to as color time slots 404). In the illustrated embodiment, time slot 404A is a red time slot, time slot 404B is a green time slot, and time slot 404C is a blue time slot. In the illustrated embodiment, the three color time slots 404 are of equal length (e.g., $1/180^{th}$ of a second). In another embodiment, the three color time slots 404 are of an unequal length. In yet another embodiment, more than three color time slots 404 are used, such as red, green, blue, and white color time slots.

In one embodiment, display device 26 uses an RGB (red-green-blue) color wheel to generate red, green, and blue light. Red time slot 404A represents the amount of time allocated to red light per frame. Green time slot 404B represents the amount of time allocated to green light per frame. Blue time slot 404C represents the amount of time allocated to blue light per frame.

The bit-depth for each of the three colors is dependent on the switching speed of the image shifter 38, and the fraction of the frame time slot 402 allocated to the color, as shown in the following Equation I:

$$B = \left\lfloor \log_2\left(\frac{\left(\frac{1}{60}\right)g}{T_{switch}}\right)\right\rfloor \qquad \text{Equation I}$$

Where:

B=Number of bits for the color;

g=fraction of the frame time slot 402 allocated to the color; and $T_{switch}$=minimum switching time of the image shifter 38.

The symbol in Equation I that appears like a bracket surrounding the right side of the equation represents a "floor" operation. The result of the floor operation is the greatest integer that is less than or equal to the given value within the floor operation "brackets". Assuming that each of the three colors occupies one-third of the frame time slot 402 (i.e., g=⅓), and that the switching time, $T_{switch}$, of the image shifter 38 is twenty-one microseconds, Equation I indicates that the bit-depth for each of the three colors for this example is eight bits (i.e., B=8 bits). Some image shifters 38 may not be able to achieve a twenty-one microsecond switching time. Thus, assuming that the switching time, $T_{switch}$, is changed to forty-two microseconds, which is more reasonable for some image shifters 38, Equation I indicates that the bit-depth for each of the three colors is reduced to seven bits (i.e., B=7 bits), which reduces the number of light intensity levels per color by one-half.

Figure 6:
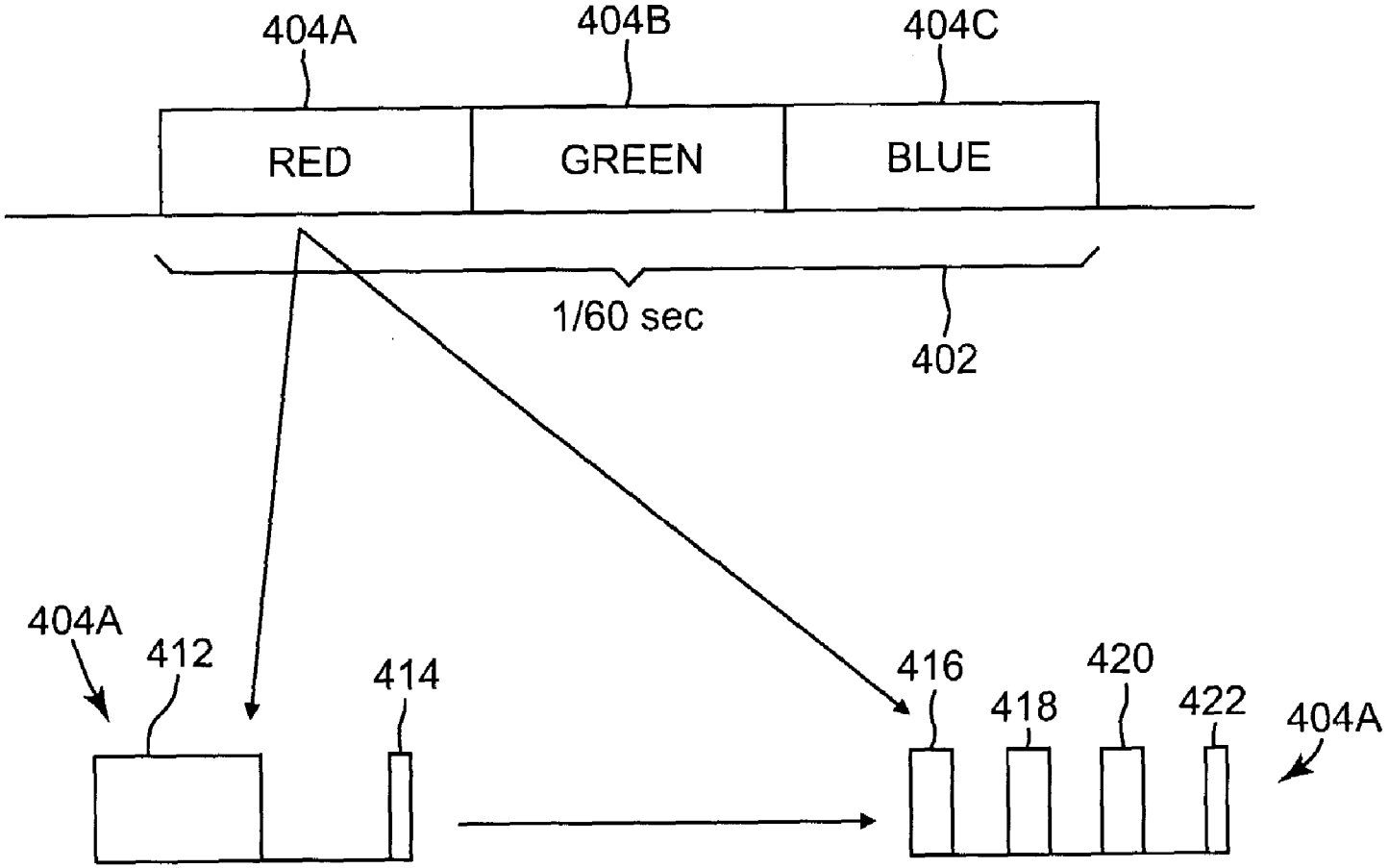
FIG. 6 is a diagram illustrating example sets of light pulses for one color time slot according to one embodiment of the present invention.

FIG. 6 is a diagram illustrating example sets of light pulses for one color time slot 404A according to one embodiment of the present invention. In one embodiment, display device 26 uses pulse-width modulation (PWM) to generate light pulses of varying widths (i.e., time durations), and thereby represent a variety of different light intensities. For the example shown in FIG. 6, a light intensity value of "9" for the red color time slot 404A is illustrated. The bit representation for a light intensity value of "9" is "1001" (i.e., $1*2^3+0*2^2+0*2^1+1*2^0=9$). The least significant bit in this example corresponds to a narrow light pulse 414. The on-time for the light pulse 414 corresponding to the least significant bit is referred to as the least significant bit (LSB) time. Thus, for example, if image shifter 38 has a minimum switching time, $T_{switch}$, of twenty-one microseconds, the LSB time will be twenty-one microseconds. Wider pulses have an on-time that is a multiple of the LSB time. The most significant bit in this example corresponds to a wider light pulse 412. The human visual system averages these two distinct pulses 412 and 414, so that the light intensity will appear to have a value of "9". Likewise, pulse-width modulation is used to generate desired light pulses for the green color time slot 404B and the blue color time slot 404C.

Using relatively wide light pulses and relatively narrow light pulses, such as light pulses 412 and 414, may cause flicker in the displayed images due to the low frequency of the switching. The human visual system is more sensitive to these lower frequencies. In one embodiment, image display system 10 uses bit-splitting to alleviate flicker. With bit-splitting, narrower light pulses are spread more evenly across the color time slot 404A to provide a higher frequency representation. For example, as shown in FIG. 6, the wide light pulse 412 is divided into three narrower light pulses 416, 418, and 420, which have a total on-time that is the same as the wide light pulse 412. In the illustrated embodiment, the narrow light pulse 422 is the same as the narrow light pulse 414. Thus, the total on-time of the light is the same for both cases, but the higher frequency of the light pulses 416–422 helps to alleviate flicker.

Figure 7:
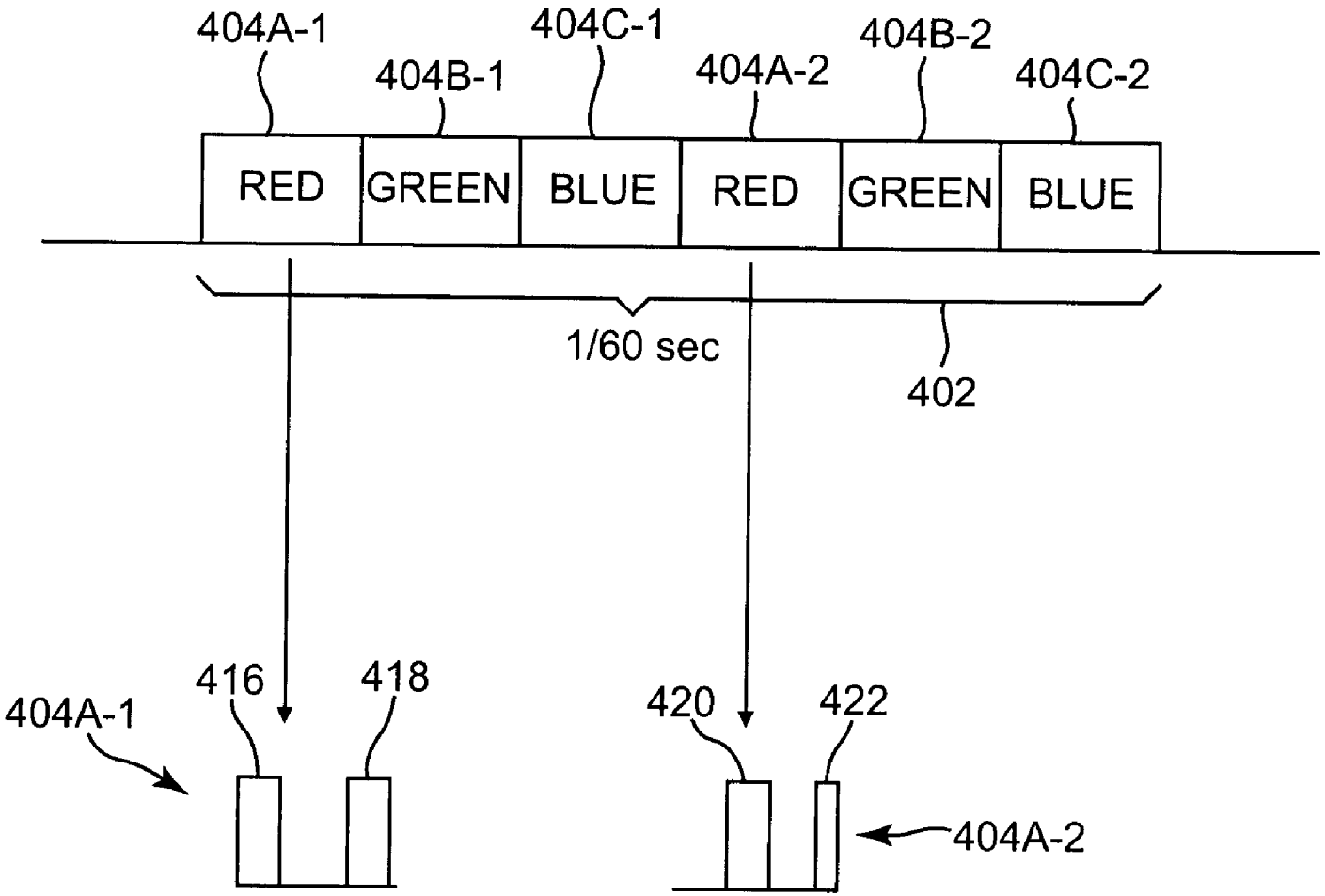
FIG. 7 is a diagram illustrating a frame time slot for a display system using 2× field sequential color (FSC) according to one embodiment of the present invention.

FIG. 7 is a diagram illustrating a frame time slot 402 for a display system 10 using 2× field sequential color (FSC) according to one embodiment of the present invention. In the illustrated embodiment, the frame time slot 402 is $1/60^{th}$ of a second in length. Frame time slot 402 includes six color time slots 404A-1, 404B-1, 404C-1, 404A-2, 404B-2, and 404C-2 (collectively referred to as color time slots 404). In the illustrated embodiment, time slots 404A-1 and 404A-2 are red time slots, time slots 404B-1 and 404B-2 are green time slots, and time slots 404C-1 and 404C-2 are blue time slots. In the illustrated embodiment, the six color time slots 404 are of equal length (e.g., $1/360^{th}$ of a second).

In one embodiment, display device 26 uses an RGB (red-green-blue) color wheel to generate red, green, and blue light, and the color wheel performs two complete rotations for each frame time slot 402, which is referred to as 2× field sequential color. Red time slots 404A-1 and 404A-2 represent the total amount of time allocated to red light per frame. Green time slots 404B-1 and 404B-2 represent the total amount of time allocated to green light per frame. Blue time slots 404C-1 and 404C-2 represent the total amount of time allocated to blue light per frame.

FIG. 7 also illustrates example sets of light pulses for red color time slots 404A-1 and 404A-2. The light pulses 416–422 shown in FIG. 7 are the same as the light pulses 416–422 shown in FIG. 6, and represent a light intensity value of "9". Since the time per frame allocated to the color red is shared by two red color time slots 404A-1 and 404A-2, two of the light pulses 416 and 418 are generated during time slot 404A-1, and the other two light pulses 420 and 422 are generated during time slot 404A-2.

Figure 8:
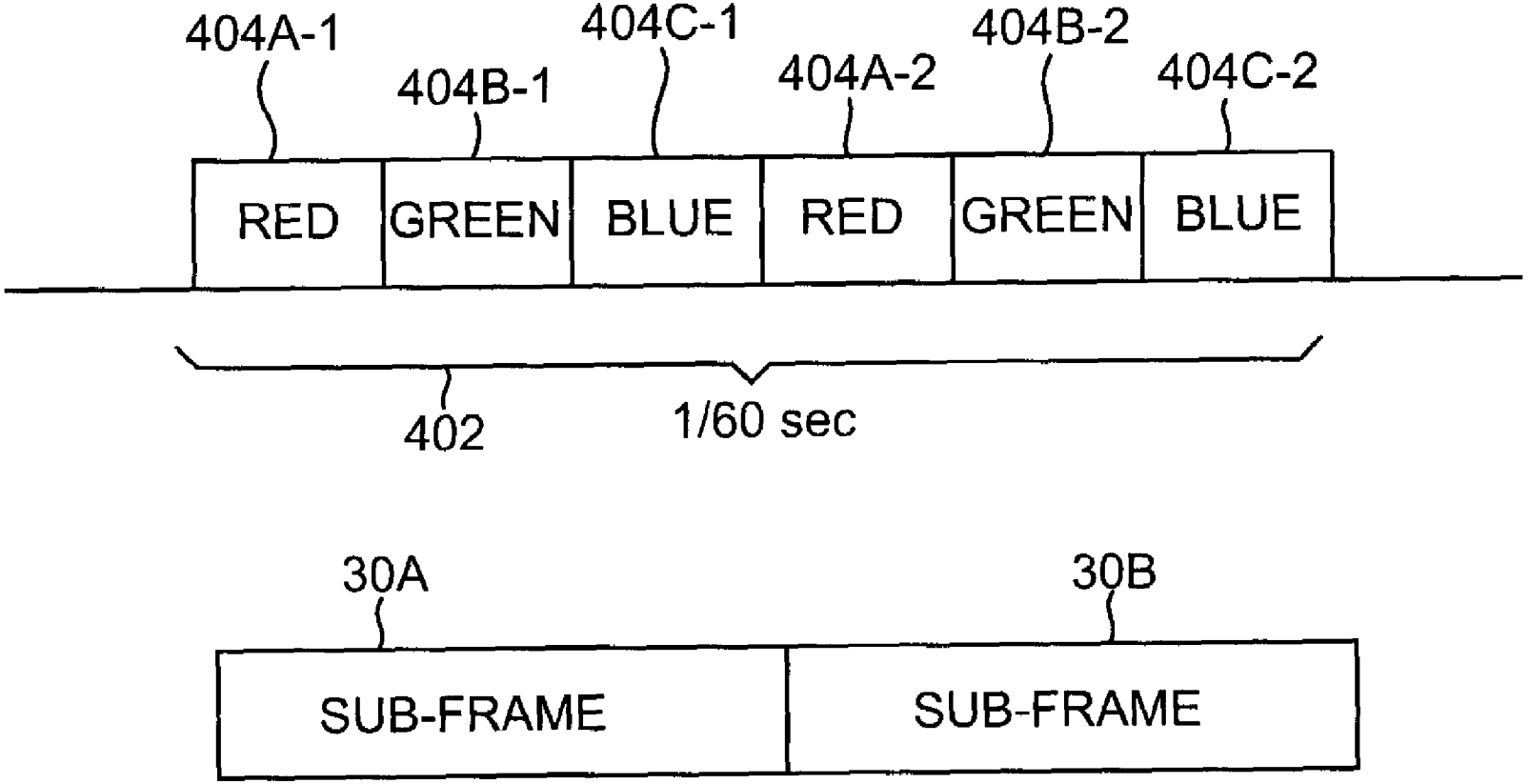
FIG. 8 is a diagram illustrating two sub-frames corresponding to a frame time slot according to one embodiment of the present invention.

FIG. 8 is a diagram illustrating two sub-frames 30A and 30B corresponding to the frame time slot 402 according to one embodiment of the present invention. In the illustrated embodiment, the frame time slot 402 is $1/60^{th}$ of a second in length, and the sub-frames 30A and 30B each occupy half of the frame time (i.e., $1/120^{th}$ of a second is allocated to each of the sub-frames 30A and 30B). Frame time slot 402 includes six color time slots 404A-1, 404B-1, 404C-1, 404A-2, 404B-2, and 404C-2 (collectively referred to as color time slots 404). In the illustrated embodiment, time slots 404A-1 and 404A-2 are red time slots, time slots 404B-1 and 404B-2 are green time slots, and time slots 404C-1 and 404C-2 are blue time slots. In the illustrated embodiment, the six color time slots 404 are of equal length (e.g., $1/360^{th}$ of a second). Time slots 404A-1, 404B-1, and 404C-1, correspond to sub-frame 30A, and time slots 404A-2, 404B-2, and 404C-2, correspond to sub-frame 30B.

As described above with reference to FIG. 5, for a switching time, $T_{switch}$, of twenty-one microseconds, the bit-depth for each of the three colors is eight bits. In one embodiment, with a bit-depth of eight bits, the maximum light intensity level that can be represented is a "252". When two-position processing or four-position processing is used, the bit-depth and the maximum light intensity level that can be represented are reduced, because the total number of bits for the frame time slot 402 is shared by two or more sub-frames.

For example, for two-position processing, each of the sub-frames 30A and 30B occupies half of the frame time slot 402, and uses half of the total number of bits for the frame time slot 402. Thus, for two-position processing and a switching time, $T_{switch}$, of twenty-one microseconds, the bit-depth per sub-frame 30A or 30B for each of the three colors is seven bits, and the maximum light intensity level that can be represented per sub-frame is "126". With a bit-depth of seven bits, 127 intensity levels can be represented (e.g., 0, 1, 2, . . . , 126). For two-position processing and a switching time, $T_{switch}$, of forty-two microseconds, the bit-depth per sub-frame 30A or 30B for each of the three colors is six bits, and the maximum light intensity level that can be represented per sub-frame is "126". With a bit-depth of six bits, 64 intensity levels can be represented (e.g., 0, 2, 4, . . . , 126).

As another example, for four-position processing, each of the sub-frames occupies one-fourth of the frame time slot 402, and uses one-fourth of the total number of bits for the frame time slot 402. Thus, for four-position processing and a switching time, $T_{switch}$, of twenty-one microseconds, the bit-depth per sub-frame for each of the three colors is six bits, and the maximum light intensity level that can be represented per sub-frame is "62". With a bit-depth of six bits, 63 intensity levels can be represented (e.g., 0, 1, 2, . . . , 62). For four-position processing and a switching time, $T_{switch}$, of forty-two microseconds, the bit-depth per sub-frame for each of the three colors is five bits, and the maximum light intensity level that can be represented per sub-frame is "62". With a bit-depth of five bits, 32 intensity levels can be represented (e.g., 0, 2, 4, . . . , 62).

As mentioned above, the lower bit-depth associated with two-position and four-position processing can lead to contouring artifacts in the displayed images. In one embodiment, initial sub-frames are generated by sub-frame generator 36, and then the sub-frames are spatio-temporal dithered. Display of the dithered sub-frames results in a reduction or elimination of the contouring artifacts. Before describing spatio-temporal dithering in further detail, techniques for generating the initial sub-frames are described below with reference to FIGS. 9–12.

III. Generation of Initial Sub-frames

Sub-frame generation unit 36 (FIG. 1) generates sub-frames 30 based on image data in image frame 28. It will be understood by a person of ordinary skill in the art that functions performed by sub-frame generation unit 36 may be implemented in hardware, software, firmware, or any combination thereof. The implementation may be via a microprocessor, programmable logic device, or state machine. Components of the present invention may reside in software on one or more computer-readable mediums. The term computer-readable medium as used herein is defined to include any kind of memory, volatile or non-volatile, such as floppy disks, hard disks, CD-ROMs, flash memory, read-only memory (ROM), and random access memory.

In one form of the invention, sub-frames 30 have a lower resolution than image frame 28. Thus, sub-frames 30 are also referred to herein as low resolution images 30, and image frame 28 is also referred to herein as a high resolution image 28. It will be understood by persons of ordinary skill in the art that the terms low resolution and high resolution are used herein in a comparative fashion, and are not limited to any particular minimum or maximum number of pixels. In one embodiment, sub-frame generation unit 36 is configured to generate sub-frames 30 based on a nearest neighbor technique as described below with reference to FIG. 9. In another embodiment, sub-frame generation unit 36 is configured to generate sub-frames 30 based on minimization of an error between a simulated high resolution image and a desired high resolution image 28. Techniques for generating sub-frames 30 based on minimization of an error between a simulated high resolution image and a desired high resolution image 28 are described in U.S. patent application Ser. No. 10/631,681, filed on Jul. 31, 2003, entitled GENERATING AND DISPLAYING SPATIALLY OFFSET SUB-FRAMES, and U.S. patent application Ser. No. 10/632,042, filed on Jul. 31, 2003, entitled GENERATING AND DISPLAYING SPATIALLY OFFSET SUB-FRAMES, which are incorporated by reference, and are also described below with reference to FIGS. 10–12.

Figure 9:
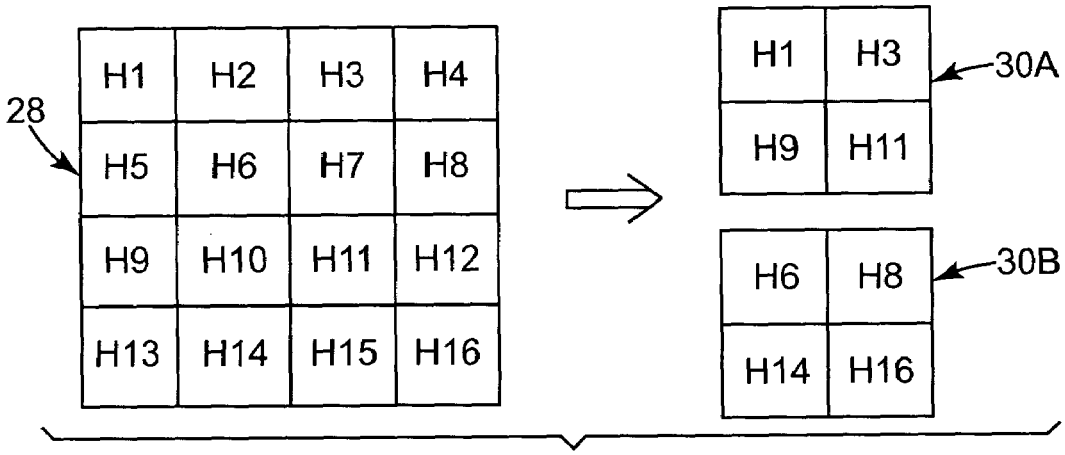
FIG. 9 is a diagram illustrating the generation of low resolution sub-frames from an original high resolution image using a nearest neighbor algorithm according to one embodiment of the present invention.

FIG. 9 is a diagram illustrating the generation of low resolution sub-frames 30A and 30B (collectively referred to as sub-frames 30) from an original high resolution image 28 using a nearest neighbor algorithm according to one embodiment of the present invention. In the illustrated embodiment, high resolution image 28 includes four columns and four rows of pixels, for a total of sixteen pixels H1–H16. In one embodiment of the nearest neighbor algorithm, a first sub-frame 30A is generated by taking every other pixel in a first row of the high resolution image 28, skipping the second row of the high resolution image 28, taking every other pixel in the third row of the high resolution image 28, and repeating this process throughout the high resolution image 28. Thus, as shown in FIG. 9, the first row of sub-frame 30A includes pixels H1 and H3, and the second row of sub-frame 30A includes pixels H9 and H11. In one form of the invention, a second sub-frame 30B is generated in the same manner as the first sub-frame 30A, but the process begins at a pixel H6 that is shifted down one row and over one column from the first pixel H1. Thus, as shown in FIG. 9, the first row of sub-frame 30B includes pixels H6 and H8, and the second row of sub-frame 30B includes pixels H14 and H16.

In one embodiment, the nearest neighbor algorithm is implemented with a 2×2 filter with three filter coefficients of "0" and a fourth filter coefficient of "1" to generate a weighted sum of the pixel values from the high resolution image. Displaying sub-frames 30A and 30B using two-position processing as described above gives the appearance of a higher resolution image. The nearest neighbor algorithm is also applicable to four-position processing, and is not limited to images having the number of pixels shown in FIG. 9.

Figure 10:
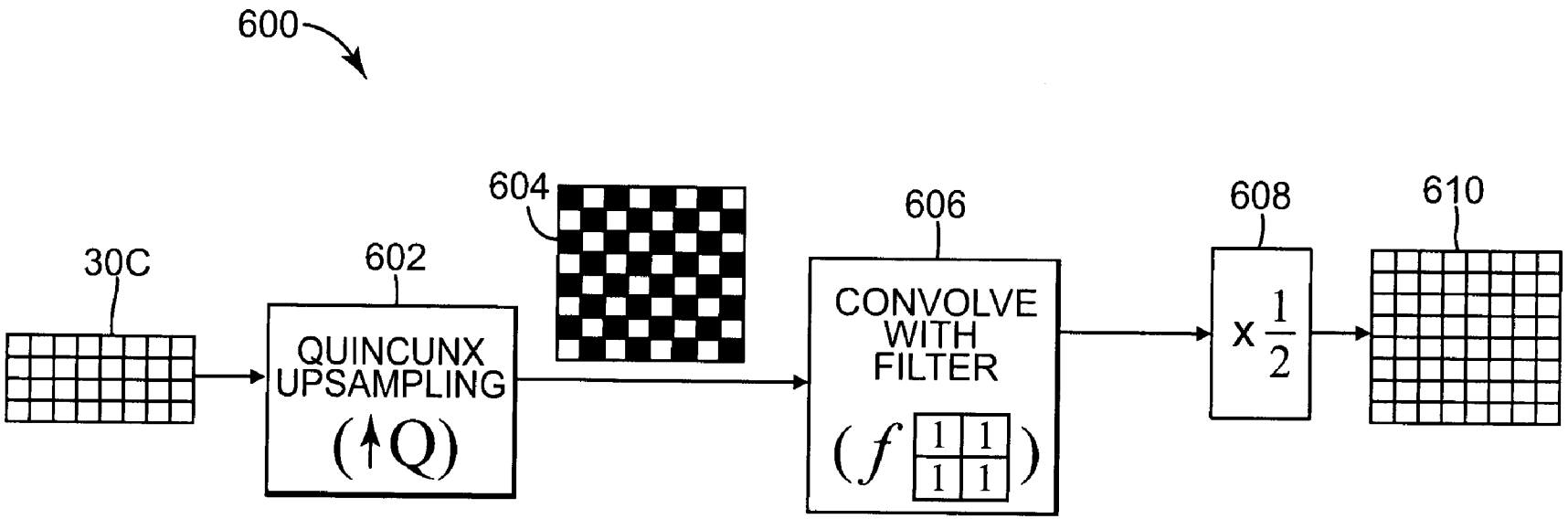
FIG. 10 is a block diagram illustrating a system for generating a simulated high resolution image for two-position processing based on non-separable upsampling according to one embodiment of the present invention.
Figure 11:
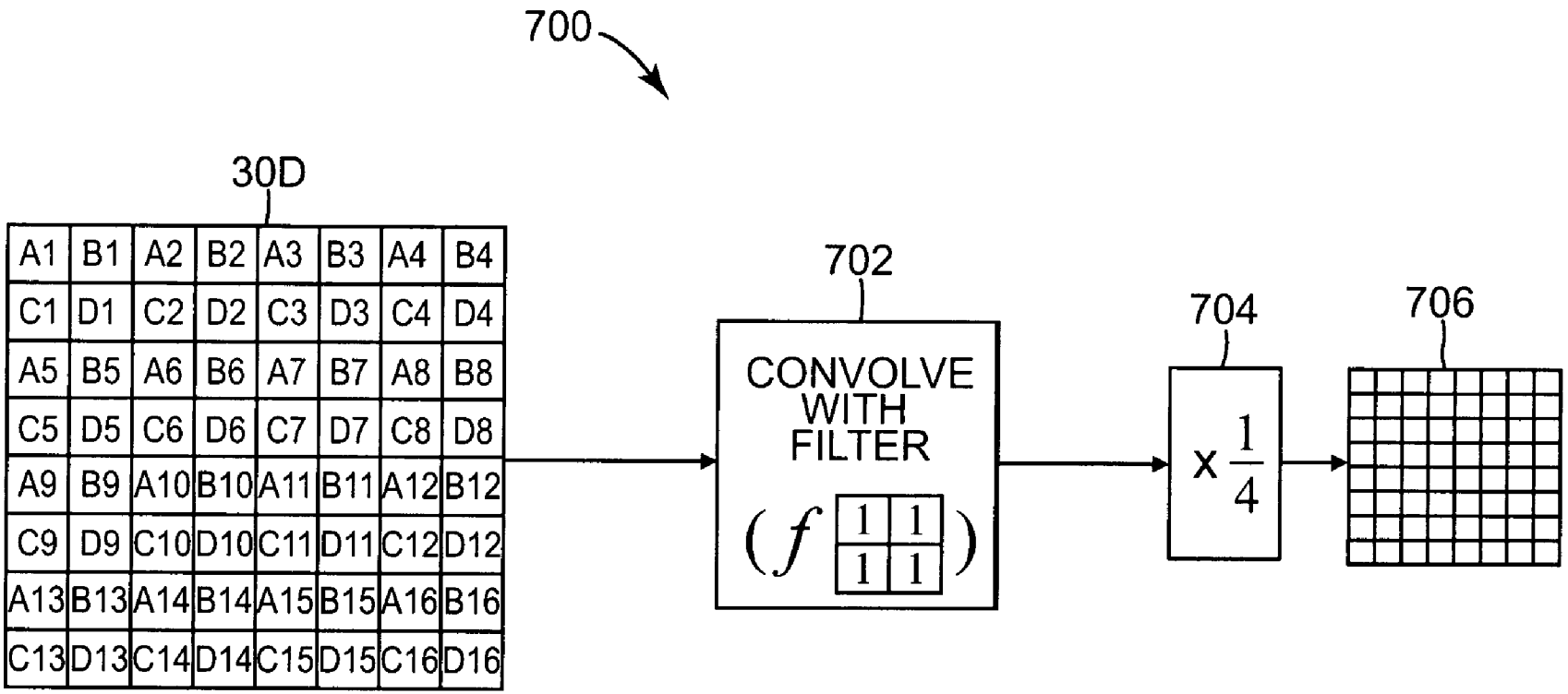
FIG. 11 is a block diagram illustrating a system for generating a simulated high resolution image for four-position processing according to one embodiment of the present invention.

FIGS. 10 and 11 illustrate systems for generating simulated high resolution images. As mentioned above, in one embodiment, sub-frames 30 are generated based on minimization of an error between a simulated high resolution image and a desired high resolution image 28. The systems for generating simulated high resolution images shown in FIGS. 10 and 11 are also used in one embodiment for designing an appropriate spatio-temporal dither array, as described in further detail below.

FIG. 10 is a block diagram illustrating a system 600 for generating a simulated high resolution image 610 for two-position processing based on non-separable upsampling of an 8×4 pixel low resolution sub-frame 30C according to one embodiment of the present invention. In one embodiment, the low resolution sub-frame data is represented by separate sub-frames, which are separately upsampled based on a diagonal sampling matrix (i.e., separable upsampling). In another embodiment, as described below with reference to FIG. 10, the low resolution sub-frame data is represented by a single sub-frame, which is upsampled based on a non-diagonal sampling matrix (i.e., non-separable upsampling).

As shown in FIG. 10, system 600 includes quincunx upsampling stage 602, convolution stage 606, and multiplication stage 608. Sub-frame 30C is upsampled by quincunx upsampling stage 602 based on a quincunx sampling matrix, Q, thereby generating upsampled image 604. The dark pixels in upsampled image 604 represent the thirty-two pixels from sub-frame 30C, and the light pixels in upsampled image 604 represent zero values. Sub-frame 30C includes pixel data for two 4×4 pixel sub-frames for two-position processing. The dark pixels in the first, third, fifth, and seventh rows of upsampled image 604 represent pixels for a first 4×4 pixel sub-frame, and the dark pixels in the second, fourth, sixth, and eighth rows of upsampled image 604 represent pixels for a second 4×4 pixel sub-frame.

The upsampled image 604 is convolved with an interpolating filter at convolution stage 606, thereby generating a blocked image. In the illustrated embodiment, the interpolating filter is a 2×2 filter with filter coefficients of "1", and with the center of the convolution being the upper left position in the 2×2 matrix. The blocked image generated by convolution stage 606 is multiplied by a factor of 0.5 at multiplication stage 608, to generate the 8×8 pixel simulated high resolution image 610.

FIG. 11 is a block diagram illustrating a system 700 for generating a simulated high resolution image 706 for four-position processing based on sub-frame 30D according to one embodiment of the present invention. In the embodiment illustrated in FIG. 11, sub-frame 30D is an 8×8 array of pixels. Sub-frame 30D includes pixel data for four 4×4 pixel sub-frames for four-position processing. Pixels A1–A16 represent pixels for a first 4×4 pixel sub-frame, pixels B1–B16 represent pixels for a second 4×4 pixel sub-frame, pixels C1–C16 represent pixels for a third 4×4 pixel sub-frame, and pixels D1–D16 represent pixels for a fourth 4×4 pixel sub-frame.

The sub-frame 30D is convolved with an interpolating filter at convolution stage 702, thereby generating a blocked image. In the illustrated embodiment, the interpolating filter is a 2×2 filter with filter coefficients of "1", and with the center of the convolution being the upper left position in the 2×2 matrix. The blocked image generated by convolution stage 702 is multiplied by a factor of 0.25 at multiplication stage 704, to generate the 8×8 pixel simulated high resolution image 706. The image data is multiplied by a factor of 0.25 at multiplication stage 704 because, in one embodiment, each of the four sub-frames represented by sub-frame 30D is displayed for only one fourth of the time slot per period allotted to a color. In another embodiment, rather than multiplying by a factor of 0.25 at multiplication stage 704, the filter coefficients of the interpolating filter are correspondingly reduced.

As described above, system 600 (FIG. 10) and system 700 (FIG. 11) generate simulated high resolution images 610 and 706, respectively, based on low resolution sub-frames. If the sub-frames are optimal, the simulated high resolution image will be as close as possible to the original high resolution image 28. Various error metrics may be used to determine how close a simulated high resolution image is to an original high resolution image, including mean square error, weighted mean square error, as well as others.

Figure 12:
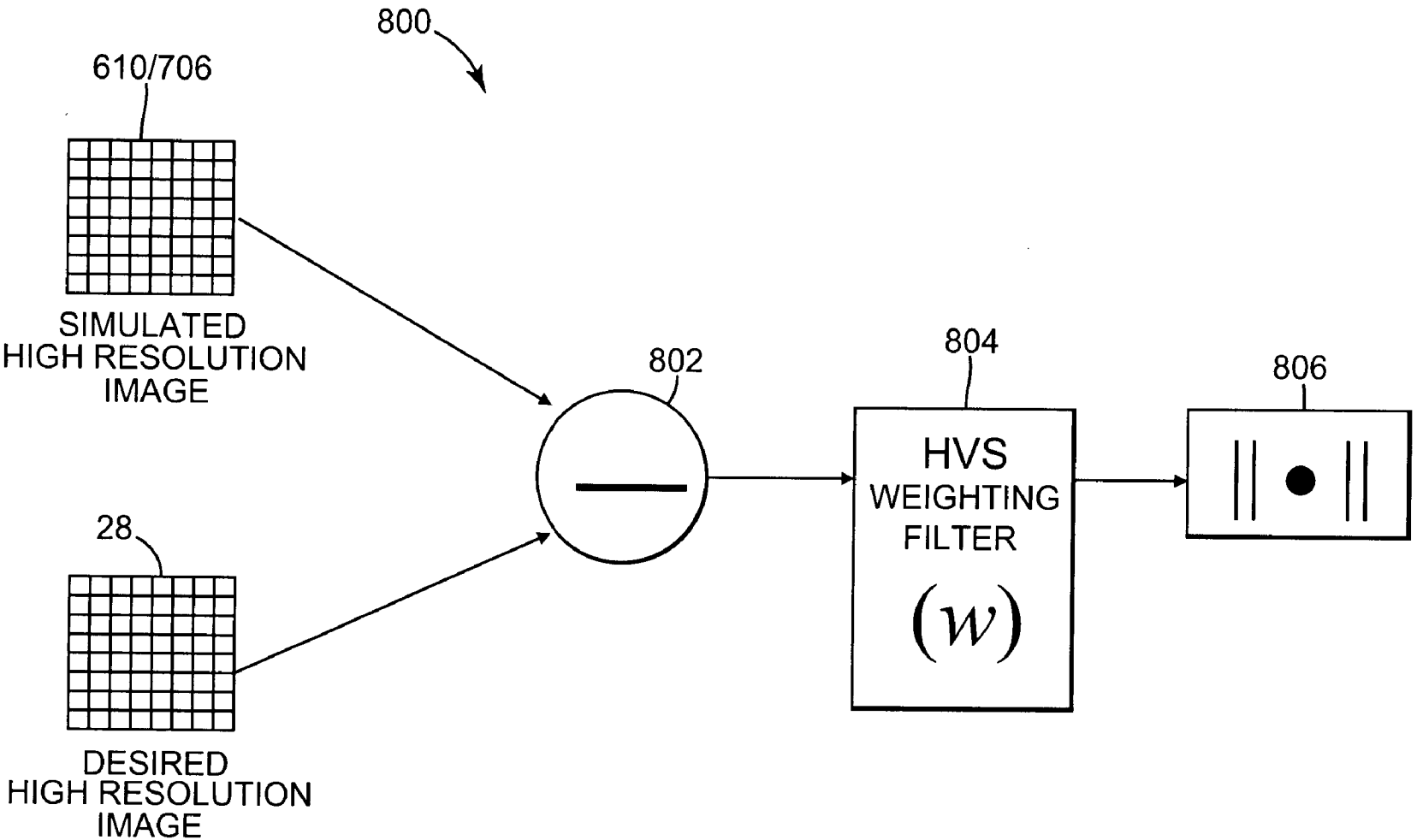
FIG. 12 is a block diagram illustrating the comparison of a simulated high resolution image and a desired high resolution image according to one embodiment of the present invention.

FIG. 12 is a block diagram illustrating the comparison of a simulated high resolution image 610/706 and a desired high resolution image 28 according to one embodiment of the present invention. A simulated high resolution image 610 or 706 is subtracted on a pixel-by-pixel basis from high resolution image 28 at subtraction stage 802. In one embodiment, the resulting error image data is filtered by a human visual system (HVS) weighting filter (W) 804. In one form of the invention, HVS weighting filter 804 filters the error image data based on characteristics of the human visual system. In one embodiment, HVS weighting filter 804 reduces or eliminates low frequency errors. The mean squared error of the filtered data is then determined at stage 806 to provide a measure of how close the simulated high resolution image 610 or 706 is to the desired high resolution image 28.

In one embodiment, systems 600 and 700 are each represented mathematically in an error cost equation that measures the difference between a simulated high resolution image 610 or 706 and the original high resolution image 28. Optimal sub-frames are identified by solving the error cost equation for the sub-frame data that provides the minimum error between the simulated high resolution image and the desired high resolution image.

IV. Spatio-Temporal Dithering

As described above with reference to FIGS. 5–8, there is a loss in bit-depth associated with two-position processing and four-position processing, which can lead to contouring artifacts in bit-constrained display systems. One form of the present invention uses frame-dependent spatio-temporal dithering to significantly reduce or eliminate the contouring artifacts associated with bit-constrained two-position processing and four-position processing.

In one embodiment, initial sub-frames 30 are generated as if no bit-depth constraints were imposed. In one form of the invention, the initial sub-frames 30 are generated by sub-frame generator 36 (FIG. 1) based on a nearest neighbor algorithm, such as described above with reference to FIG. 9. In another embodiment, the initial sub-frames 30 are generated based on minimization of an error between a desired high resolution image 28 and a simulated high resolution image. The initial sub-frames 30 are then quantized jointly by sub-frame generator 36 so that the resulting projected high-resolution image has more levels than present in the individual sub-frames 30, due to spatial averaging of the sub-frame data. In one form of the invention, the pixels of future sub-frame(s) are quantized so that averaging across successive frames results in yet more gray levels being salvaged. Spatio-temporal dithering according to one form of the invention is described in further detail below with reference to FIGS. 13–20.

Figure 13:
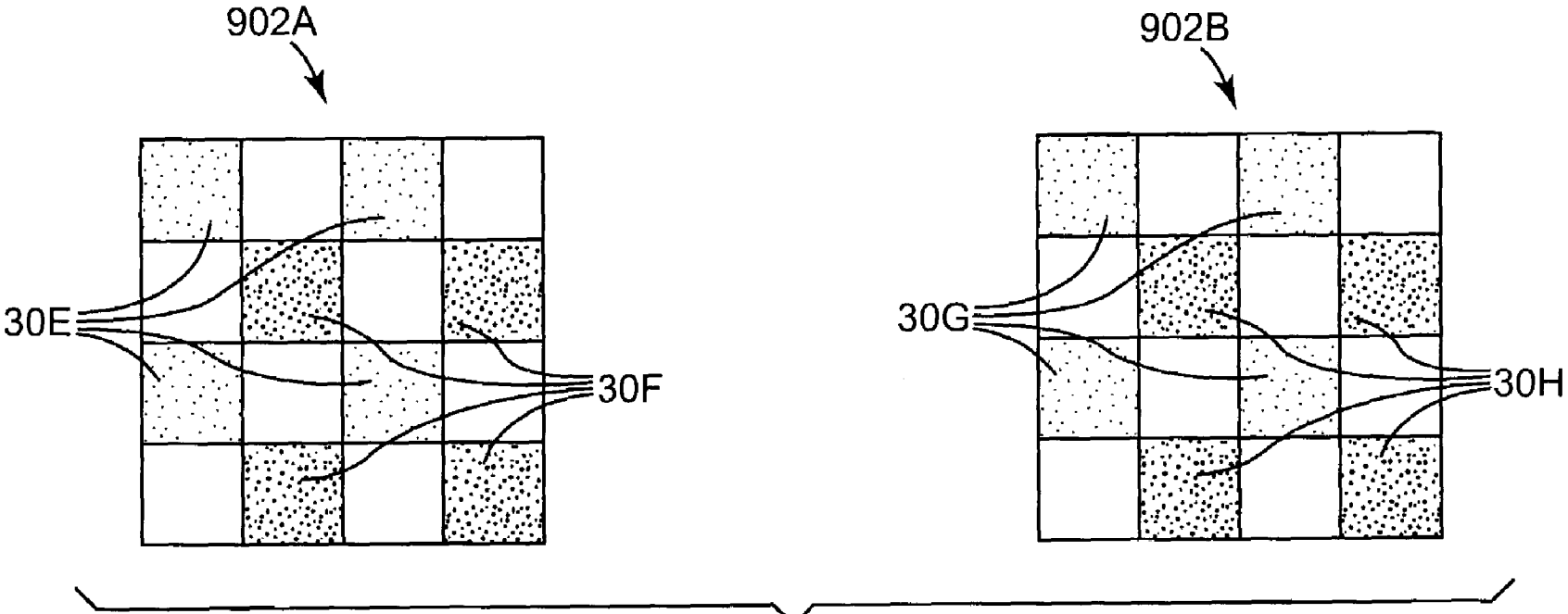
FIG. 13 is a diagram illustrating the display of sub-frames for consecutive frames based on two-position processing according to one embodiment of the present invention.

FIG. 13 is a diagram illustrating the display of sub-frames 30 for consecutive frames 902A and 902B based on two-position processing according to one embodiment of the present invention. Frame 902A is comprised of two sub-frames 30E and 30F, and the next consecutive frame 902B is comprised of two sub-frames 30G and 30H. In one embodiment, the pixel values for each pixel in sub-frame 30E (i.e., the first sub-frame for the first of two consecutive frames) are quantized according to the following Equation II:

$$a' = \left\lfloor \frac{a}{4} \right\rfloor * 4 \qquad \text{Equation II}$$

Where:

α'=quantized pixel value; and

α=original pixel value.

Thus, as shown by Equation II, the quantized pixel values for sub-frame 30E are obtained by dividing the original pixel value by four, taking the floor of the result of the division, and multiplying the result of the floor operation by four.

In one embodiment, the pixel values for each pixel in sub-frame 30F (i.e., the second sub-frame for the first of two consecutive frames) are quantized according to the following Equation III:

$$a' = \left\lfloor \frac{a+2}{4} \right\rfloor * 4 \qquad \text{Equation III}$$

Thus, as shown by Equation III, the quantized pixel values for sub-frame 30F are obtained by adding two to the original pixel value, dividing this sum by four, taking the floor of the result of the division, and multiplying the result of the floor operation by four.

In one embodiment, the pixel values for each pixel in sub-frame 30G (i.e., the first sub-frame for the second of two consecutive frames) are quantized according to the following Equation IV:

$$a' = \left\lfloor \frac{a+1}{4} \right\rfloor * 4 \qquad \text{Equation IV}$$

Thus, as shown by Equation IV, the quantized pixel values for sub-frame 30G are obtained by adding one to the original pixel value, dividing this sum by four, taking the floor of the result of the division, and multiplying the result of the floor operation by four.

In one embodiment, the pixel values for each pixel in sub-frame 30H (i.e., the second sub-frame for the second of two consecutive frames) are quantized according to the following Equation V:

$$a' = \left\lfloor \frac{a+3}{4} \right\rfloor * 4 \qquad \text{Equation V}$$

Thus, as shown by Equation V, the quantized pixel values for sub-frame 30H are obtained by adding three to the original pixel value, dividing this sum by four, taking the floor of the result of the division, and multiplying the result of the floor operation by four.

For original 8-bit pixel values, for example, the quantization from Equations II–V above results in 65 possible values for each pixel, in the range of 0, 4, 8, . . . , 256. In one embodiment, quantized values above 252 are clipped to 252, so that there are 64 possible values (i.e., 6 bits) for each pixel, in the range of 0, 4, 8, . . . , 252. As indicated by Equations II–V above, the two sub-frames 30 for each individual frame are quantized differently, and corresponding sub-frames in consecutive frames (e.g., sub-frames 30E and 30G) are quantized differently. The use of different quantizing functions for a single frame provides a spatial dithering function, and the use of different quantizing functions from frame to frame provides a temporal dithering function. The use of different quantizing functions in this manner is referred to herein as spatio-temporal dithering.

Spatio-temporal dithering of sub-frames according to one embodiment of the invention produces more intensity levels in the displayed image than are present in the individual sub-frames. The generation of additional intensity levels based on spatio-temporal dithering is described in further detail below with a couple of examples. A first example, using two-position processing, is described with reference to FIGS. 14–16. A second example, using four-position processing, is described with reference to FIGS. 18–20. In each of these two examples, simulated high resolution images for two consecutive frames are generated based on spatio-temporal dithered sub-frames. The simulated high resolution images indicate how the actual displayed images would appear if the spatio-temporal dithered sub-frames were actually displayed using two-position or four-position processing.

Figure 14:
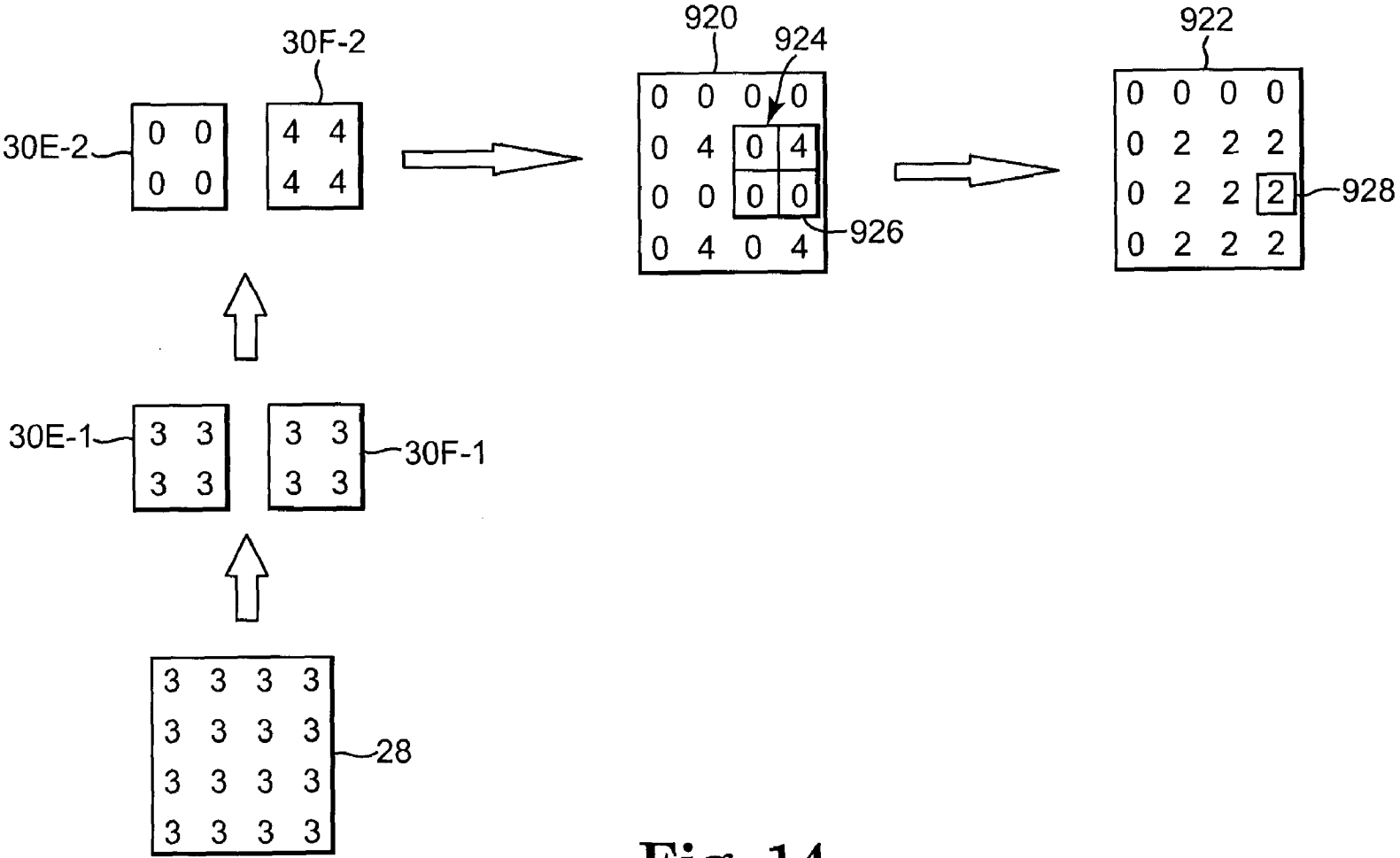
FIG. 14 is a diagram illustrating the generation of a simulated high resolution image corresponding to a first of two consecutive frames based on two-position processing and dithering of sub-frames according to one embodiment of the present invention.

FIG. 14 is a diagram illustrating the generation of a simulated high resolution image 922 corresponding to a first of two consecutive frames based on two-position processing and dithering of sub-frames according to one embodiment of the present invention. An initial set of low resolution sub-frames 30E-1 and 30F-1 are generated based on an original high resolution image 28. In the illustrated embodiment, the initial set of sub-frames 30E-1 and 30F-1 are generated using an embodiment of the nearest neighbor algorithm described above with reference to FIG. 9.

Assuming that the sub-frames are constrained to a bit-depth of six bits, with possible values in the range 0, 4, 8, . . . , 252, the pixel value "3", for example, could not be represented in the sub-frames. The pixel values in the initial set of sub-frames 30E-1 and 30F-1 are, therefore, quantized to appropriate values in the above-specified range. Sub-frame 30E-1 is quantized based on Equation II above to generate corresponding quantized sub-frame 30E-2. Sub-frame 30F-1 is quantized based on Equation III above to generate corresponding quantized sub-frame 30F-2. The quantized sub-frames 30E-2 and 30F-2 are upsampled to generate upsampled image 920. The upsampled image 920 is convolved with an interpolating filter 924, thereby generating a blocked image, which is then multiplied by a factor of 0.5 to generate simulated high resolution image 922.

In one embodiment, the interpolating filter 924 is a 2×2 filter with filter coefficients of "1", and with the center of the convolution being the upper left position in the 2×2 matrix. The lower right pixel 926 of the interpolating filter 924 is positioned over each pixel in image 920 to determine the blocked value for that pixel position. For example, as shown in FIG. 14, the lower right pixel 926 of the interpolating filter 924 is positioned over the pixel in the third row and fourth column of image 920, which has a value of "0". The blocked value for that pixel position is determined by multiplying the filter coefficients by the pixel values within the window of the filter 924, and adding the results. Out-of-frame values are considered to be "0". For the illustrated embodiment, the blocked value for the pixel in the third row and fourth column of image 920 is given by the following Equation VI $$(1\times0)+(1\times4)+(1\times0)+(1\times0)=4 \qquad \text{Equation VI}$$

The value in Equation VI is then multiplied by the factor 0.5, and the result (i.e., 2) is the pixel value for the pixel 928 in the third row and the fourth column of the simulated high resolution image 922.

Figure 15:
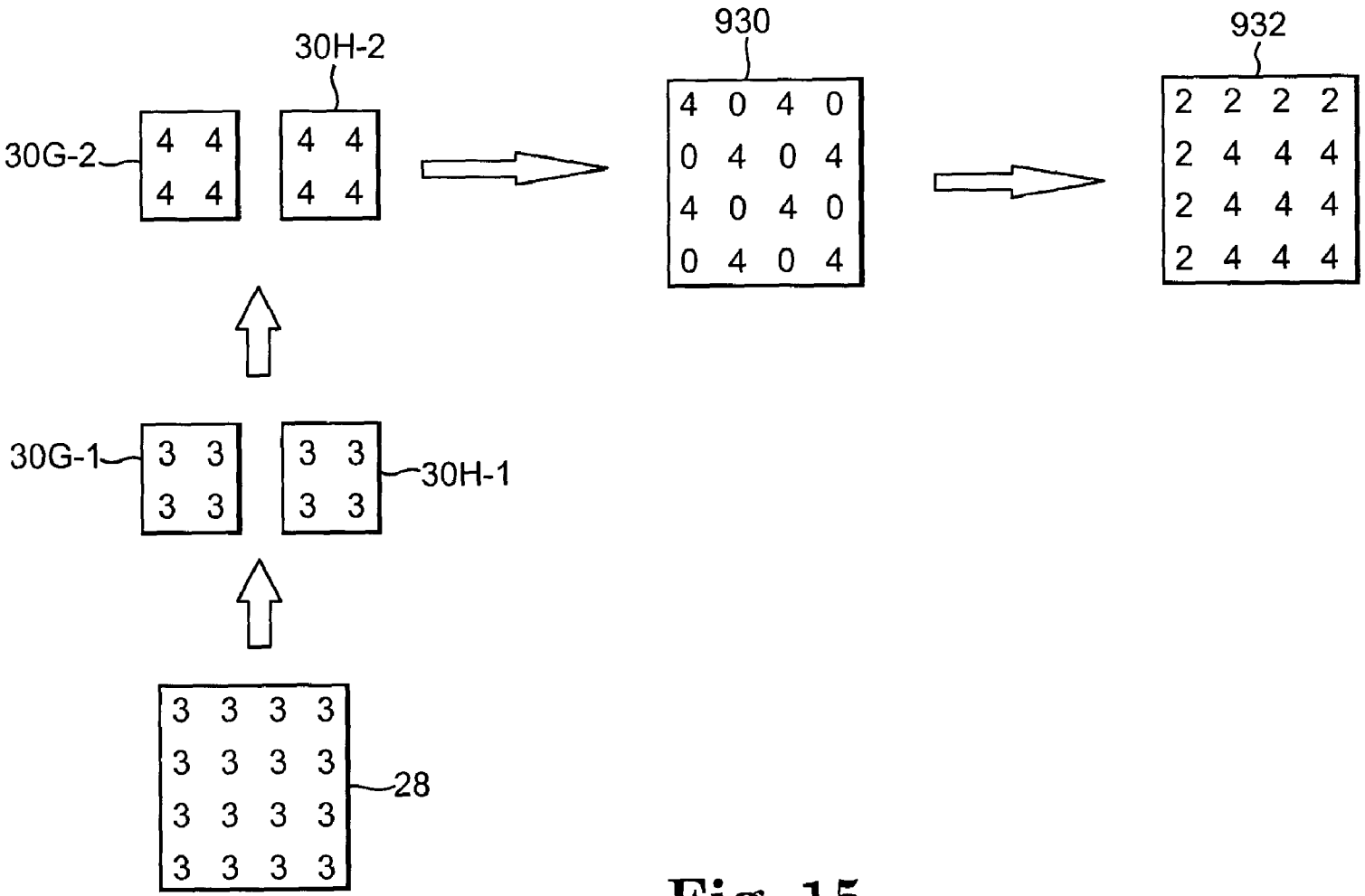
FIG. 15 is a diagram illustrating the generation of a simulated high resolution image corresponding to a second of two consecutive frames based on two-position processing and dithering of sub-frames according to one embodiment of the present invention.

FIG. 15 is a diagram illustrating the generation of a simulated high resolution image 932 corresponding to a second of two consecutive frames based on two-position processing and dithering of sub-frames according to one embodiment of the present invention. An initial set of low resolution sub-frames 30G-1 and 30H-1 are generated based on an original high resolution image 28. In the illustrated embodiment, the initial set of sub-frames 30G-1 and 30H-1 are generated using an embodiment of the nearest neighbor algorithm described above with reference to FIG. 9.

Sub-frame 30G-1 is quantized based on Equation IV above to generate corresponding quantized sub-frame 30G-2. Sub-frame 30H-1 is quantized based on Equation V above to generate corresponding quantized sub-frame 30H-2. The quantized sub-frames 30G-2 and 30H-2 are upsampled to generate upsampled image 930. The upsampled image 930 is convolved with an interpolating filter 924 (FIG. 14), thereby generating a blocked image, which is then multiplied by a factor of 0.5 to generate simulated high resolution image 932.

Figure 16:
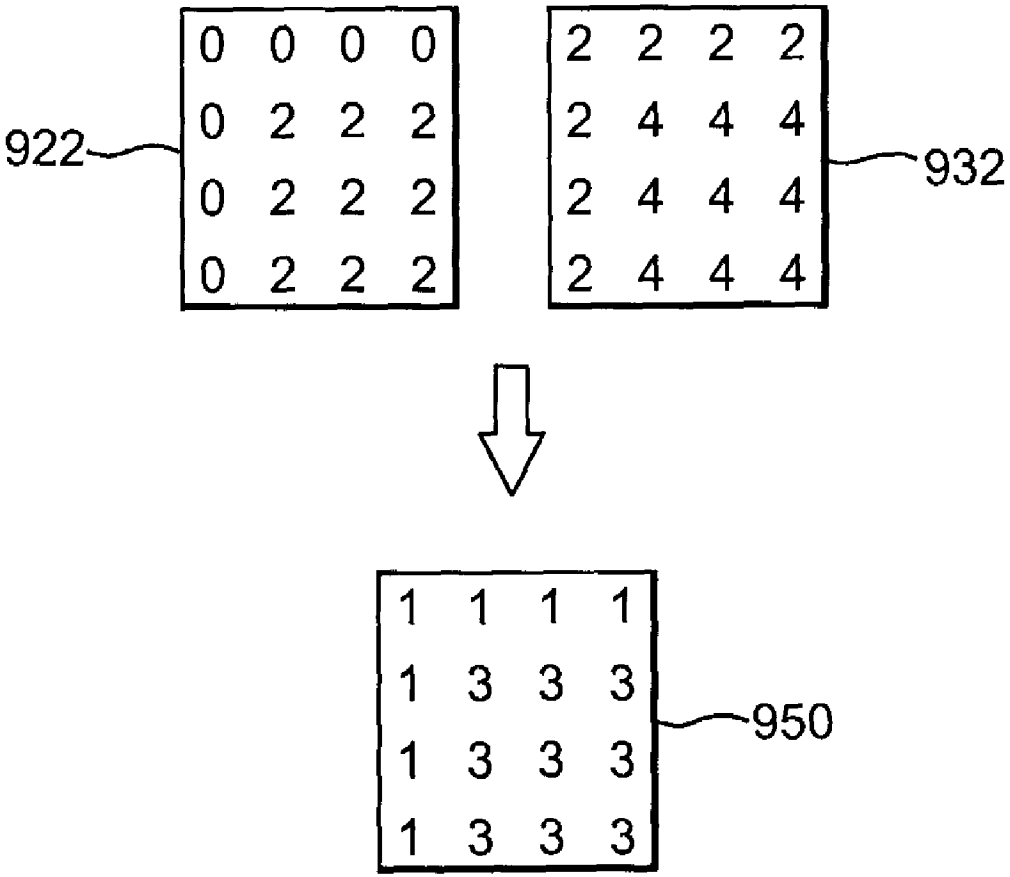
FIG. 16 is a diagram illustrating a high resolution image that represents an average of the simulated high resolution images shown in FIGS. 14 and 15.

FIG. 16 is a diagram illustrating a high resolution image 950 that represents an average of the simulated high resolution images 922 and 932 shown in FIGS. 14 and 15, respectively. Each pixel in the high resolution image 950 is the average of the corresponding pixels in the simulated images 922 and 932. The human visual system tends to average temporally. Thus, when two frames (or the sub-frames for two frames) are displayed in relatively quick succession, the human visual system will tend to average the two frames. Thus, displaying the quantized sub-frames 30E-2 and 30F-2 using two-position processing, followed by displaying the quantized sub-frames 30G-2 and 30H-2 using two-position processing, will appear to the human visual system as high resolution image 950. Most of the pixels in high resolution image 950 have a value of "3". Thus, the spatio-temporal dithering provides a resulting image that is very close to the desired high resolution image 28 (FIGS. 14 and 15), which consists of all 3's. Even though the sub-frames are bit-constrained to, for example, a bit-depth of six bits, the displayed images will have a higher bit-depth (e.g., 8 bits).

In contrast, if a uniform quantization were performed, rather than the spatio-temporal dither described above, the additional intensity levels would not be recovered, and contouring artifacts would result. For example, if a uniform rule was used for each pixel, such as simply dividing each pixel by four, taking the floor of the result of the division, and multiplying the result of the floor operation by four, all of the pixels in sub-frames 30E-2 and 30F-2 (FIG. 14) and sub-frames 30G-2 and 30H-2 (FIG. 15) would be zero. Thus, the level "3" would not be represented.

Figure 17:
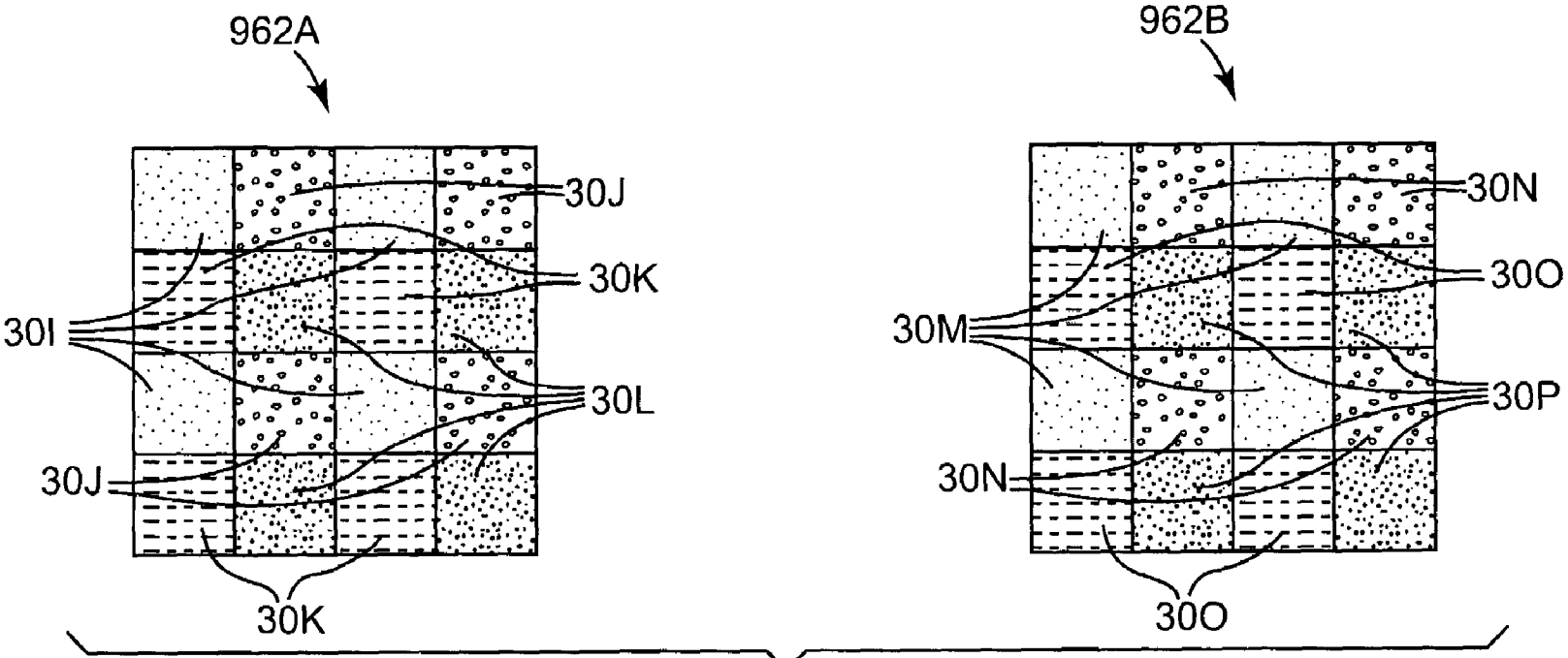
FIG. 17 is a diagram illustrating the display of sub-frames for consecutive frames based on four-position processing according to one embodiment of the present invention.

FIG. 17 is a diagram illustrating the display of sub-frames for consecutive frames 962A and 962B based on four-position processing according to one embodiment of the present invention. Frame 962A is comprised of four sub-frames 30I–30L, and the next consecutive frame 962B is comprised of four sub-frames 30M–30P. In one embodiment, the pixel values for each pixel in sub-frame 30I (i.e., the first sub-frame for the first of two consecutive frames) are quantized according to the following Equation VII:

$$a' = \left\lfloor \frac{a}{8} \right\rfloor * 8 \quad \text{Equation VII}$$

Where:

α'=quantized pixel value; and

α=original pixel value.

Thus, as shown by Equation VII, the quantized pixel values for sub-frame 30I are obtained by dividing the original pixel value by eight, taking the floor of the result of the division, and multiplying the result of the floor operation by eight.

In one embodiment, the pixel values for each pixel in sub-frame 30J (i.e., the second sub-frame for the first of two consecutive frames) are quantized according to the following Equation VIII:

$$a' = \left\lfloor \frac{a+2}{8} \right\rfloor * 8 \quad \text{Equation VIII}$$

Thus, as shown by Equation VIII, the quantized pixel values for sub-frame 30J are obtained by adding two to the original pixel value, dividing this sum by eight, taking the floor of the result of the division, and multiplying the result of the floor operation by eight.

In one embodiment, the pixel values for each pixel in sub-frame 30K (i.e., the third sub-frame for the first of two consecutive frames) are quantized according to the following Equation IX:

$$a' = \left\lfloor \frac{a+4}{8} \right\rfloor * 8 \quad \text{Equation IX}$$

Thus, as shown by Equation IX, the quantized pixel values for sub-frame 30K are obtained by adding four to the original pixel value, dividing this sum by eight, taking the floor of the result of the division, and multiplying the result of the floor operation by eight.

In one embodiment, the pixel values for each pixel in sub-frame 30L (i.e., the fourth sub-frame for the first of two consecutive frames) are quantized according to the following Equation X:

$$a' = \left\lfloor \frac{a+6}{8} \right\rfloor * 8 \quad \text{Equation X}$$

Thus, as shown by Equation X, the quantized pixel values for sub-frame 30L are obtained by adding six to the original pixel value, dividing this sum by eight, taking the floor of the result of the division, and multiplying the result of the floor operation by eight.

In one embodiment, the pixel values for each pixel in sub-frame 30M (i.e., the first sub-frame for the second of two consecutive frames) are quantized according to the following Equation XI:

$$a' = \left\lfloor \frac{a+1}{8} \right\rfloor * 8 \quad \text{Equation XI}$$

Thus, as shown by Equation XI, the quantized pixel values for sub-frame 30M are obtained by adding one to the original pixel value, dividing this sum by eight, taking the floor of the result of the division, and multiplying the result of the floor operation by eight.

In one embodiment, the pixel values for each pixel in sub-frame 30N (i.e., the second sub-frame for the second of two consecutive frames) are quantized according to the following Equation XII:

$$a' = \left\lfloor \frac{a+3}{8} \right\rfloor * 8 \quad \text{Equation XII}$$

Thus, as shown by Equation XII, the quantized pixel values for sub-frame 30N are obtained by adding three to the original pixel value, dividing this sum by eight, taking the floor of the result of the division, and multiplying the result of the floor operation by eight.

In one embodiment, the pixel values for each pixel in sub-frame 300 (i.e., the third sub-frame for the second of two consecutive frames) are quantized according to the following Equation XIII:

$$a' = \left\lfloor \frac{a+5}{8} \right\rfloor * 8 \quad \text{Equation XIII}$$

Thus, as shown by Equation XIII, the quantized pixel values for sub-frame 30O are obtained by adding five to the original pixel value, dividing this sum by eight, taking the floor of the result of the division, and multiplying the result of the floor operation by eight.

In one embodiment, the pixel values for each pixel in sub-frame 30P (i.e., the fourth sub-frame for the second of two consecutive frames) are quantized according to the following Equation XIV:

$$a' = \left\lfloor \frac{a+7}{8} \right\rfloor * 8 \quad \text{Equation XIV}$$

Thus, as shown by Equation XIV, the quantized pixel values for sub-frame 30P are obtained by adding seven to the original pixel value, dividing this sum by eight, taking the floor of the result of the division, and multiplying the result of the floor operation by eight.

For original 8-bit pixel values, for example, the quantization from Equations VII–XIV above results in 33 possible values for each pixel, in the range of 0, 8, 16, . . . 256. In one embodiment, quantized values above 248 are clipped to 248, so that there are 32 possible values (i.e., 5 bits) for each pixel, in the range of 0, 8, 16, . . . , 248. As indicated by Equations VII–XIV above, the four sub-frames 30 for each individual frame are quantized differently, and corresponding sub-frames in consecutive frames (e.g., sub-frames 30I and 30M) are quantized differently, which provides spatio-temporal dithering.

Spatio-temporal dithering of sub-frames according to one embodiment of the invention produces more intensity levels in the displayed image than are present in the individual sub-frames. The generation of additional intensity levels based on spatio-temporal dithering and four position processing is described in further detail below with reference to an example illustrated in FIGS. 18–20.

Figure 18:
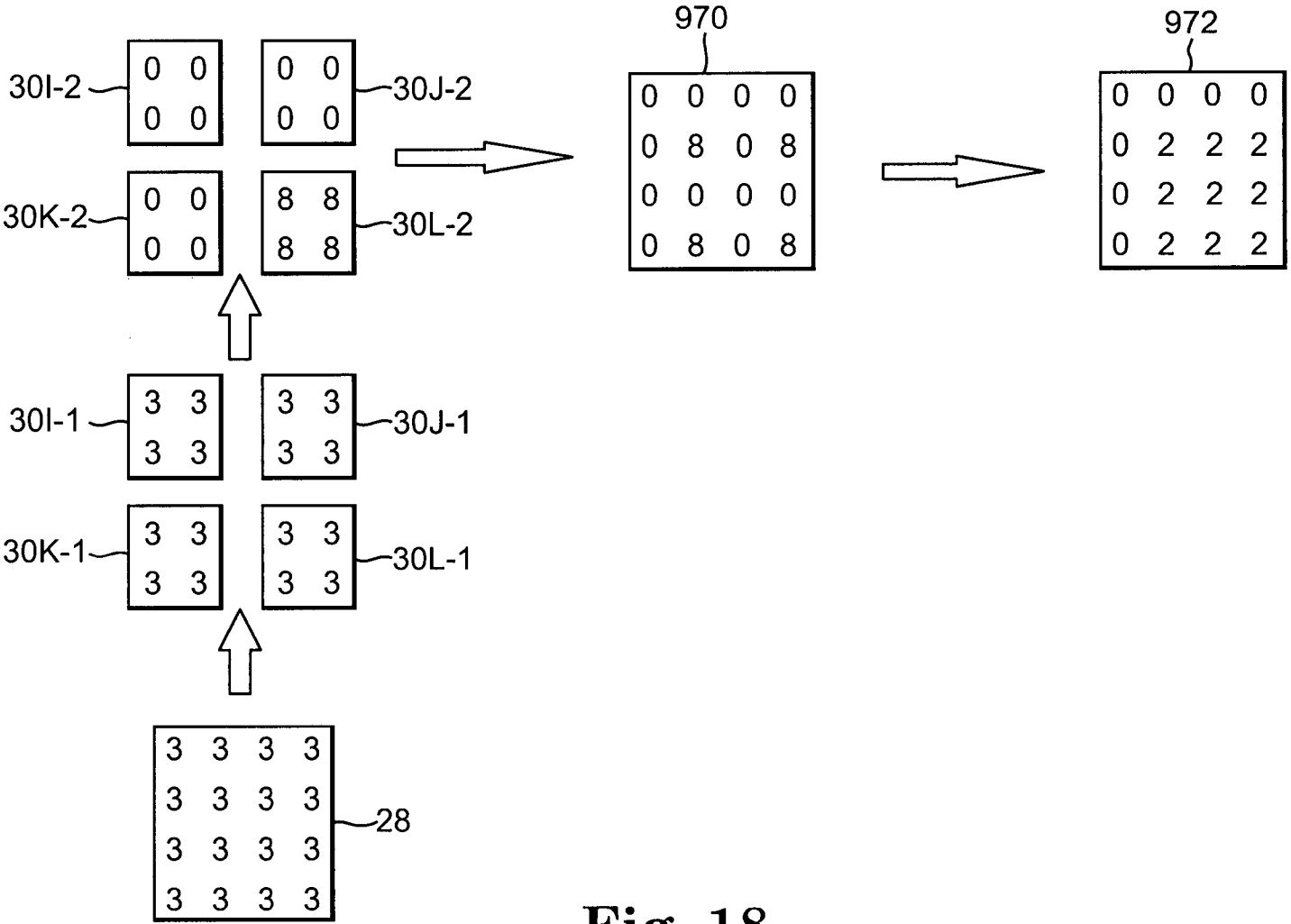
FIG. 18 is a diagram illustrating the generation of a simulated high resolution image corresponding to a first of two consecutive frames based on four-position processing and dithering of sub-frames according to one embodiment of the present invention.

FIG. 18 is a diagram illustrating the generation of a simulated high resolution image 972 corresponding to a first of two consecutive frames based on four-position processing and dithering of sub-frames according to one embodiment of the present invention. An initial set of low resolution sub-frames 30I-1, 30J-1, 30K-1, and 30L-1 are generated based on an original high resolution image 28. In the illustrated embodiment, the initial set of sub-frames 30I-1, 30J-1, 30K-1, and 30L-1 are generated using an embodiment of the nearest neighbor algorithm described above with reference to FIG. 9.

Assuming that the sub-frames are constrained to a bit-depth of five bits, with possible values in the range 0, 8, 16, . . . , 248, the pixel value "3", for example, could not be represented in the sub-frames. The pixel values in the initial set of sub-frames 30I-1, 30J-1, 30K-1, and 30L-1 are, therefore, quantized to appropriate values in the above-specified range. Sub-frame 301-1 is quantized based on Equation VII above to generate corresponding quantized sub-frame 30I-2. Sub-frame 30J-1 is quantized based on Equation VIII above to generate corresponding quantized sub-frame 30J-2. Sub-frame 30K-1 is quantized based on Equation IX above to generate corresponding quantized sub-frame 30K-2. Sub-frame 30L-I is quantized based on Equation X above to generate corresponding quantized sub-frame 30L-2. The quantized sub-frames 30I-2, 30J-2, 30K-2, and 30L-2 are combined in the manner illustrated in FIG. 11 to generate image 970. The image 970 is convolved with an interpolating filter 924 (FIG. 14), thereby generating a blocked image, which is then multiplied by a factor of 0.25 to generate simulated high resolution image 972.

Figure 19:
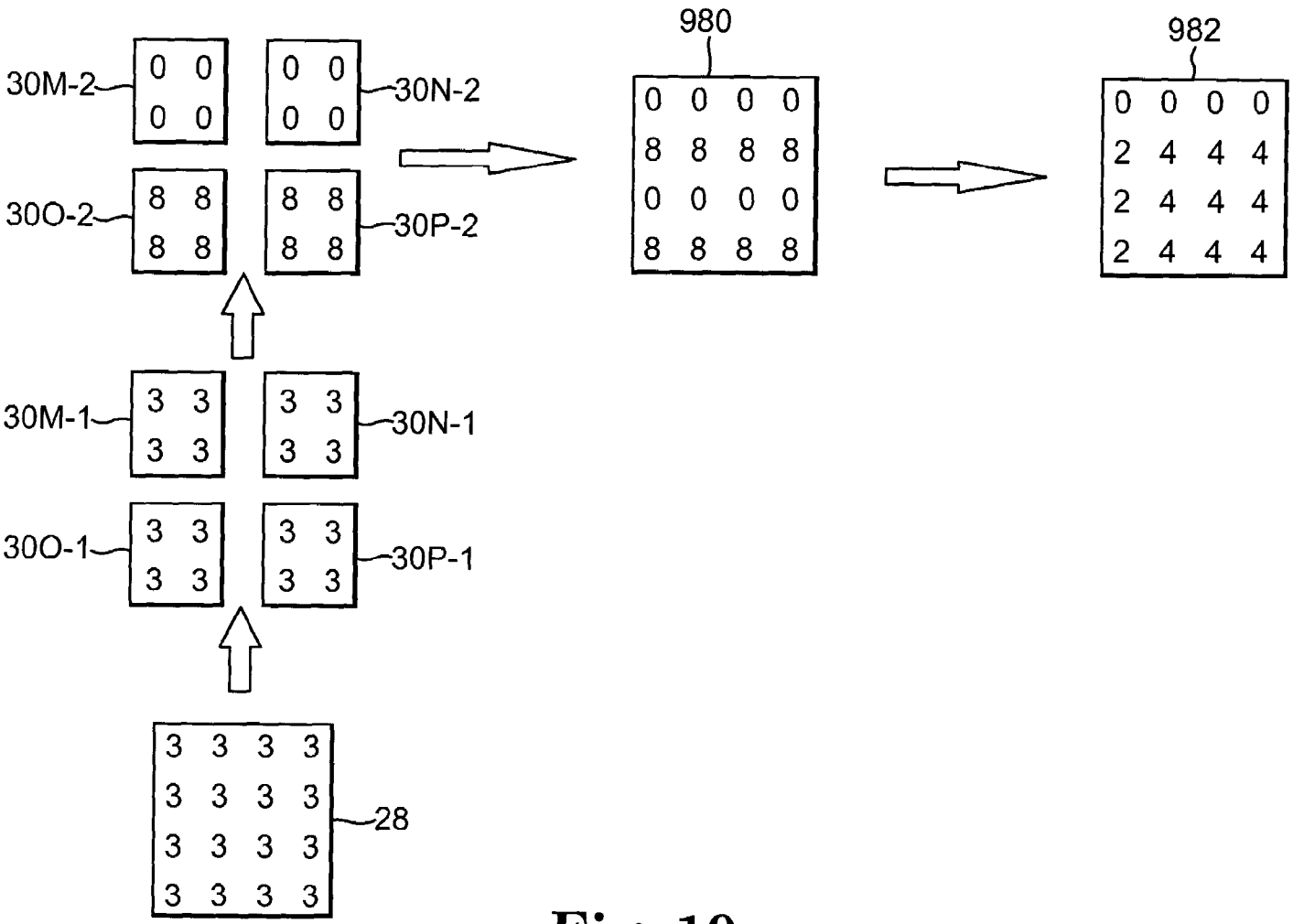
FIG. 19 is a diagram illustrating the generation of a simulated high resolution image corresponding to a second of two consecutive frames based on four-position processing and dithering of sub-frames according to one embodiment of the present invention.

FIG. 19 is a diagram illustrating the generation of a simulated high resolution image 982 corresponding to a second of two consecutive frames based on four-position processing and dithering of sub-frames according to one embodiment of the present invention. An initial set of low resolution sub-frames 30M-1, 30N-1, 30O-1, and 30P-1 are generated based on an original high resolution image 28. In the illustrated embodiment, the initial set of sub-frames 30M-1, 30N-1, 30O-1, and 30P-1 are generated using an embodiment of the nearest neighbor algorithm described above with reference to FIG. 9.

Sub-frame 30M-1 is quantized based on Equation XI above to generate corresponding quantized sub-frame 30M-2. Sub-frame 30N-1 is quantized based on Equation XII above to generate corresponding quantized sub-frame 30N-2. Sub-frame 30O-1 is quantized based on Equation XIII above to generate corresponding quantized sub-frame 30O-2. Sub-frame 30P-1 is quantized based on Equation XIV above to generate corresponding quantized sub-frame 30P-2. The quantized sub-frames 30M-2, 30N-2, 30O-2, and 30P-2 are combined in the manner illustrated in FIG. 11 to generate image 980. The image 980 is convolved with an interpolating filter 924 (FIG. 14), thereby generating a blocked image, which is then multiplied by a factor of 0.25 to generate simulated high resolution image 982.

Figure 20:
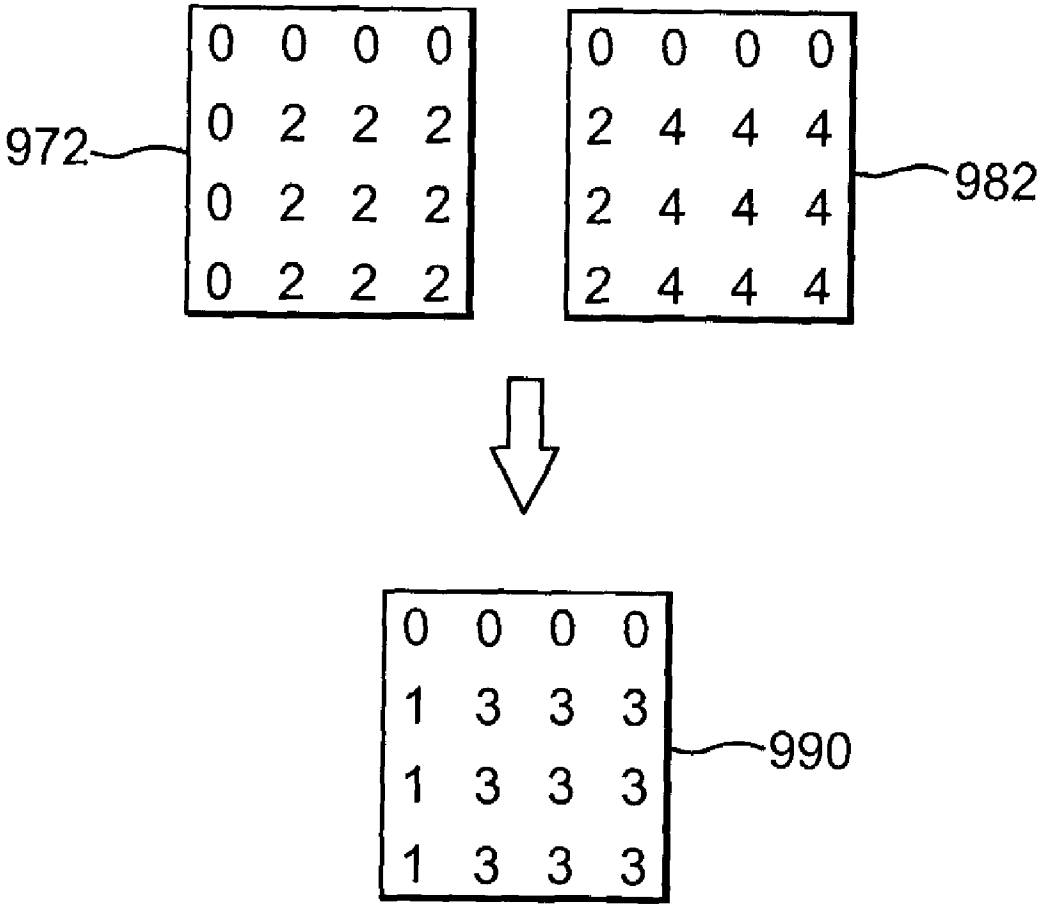
FIG. 20 is a diagram illustrating a high resolution image that represents an average of the simulated high resolution images shown in FIGS. 18 and 19.

FIG. 20 is a diagram illustrating a high resolution image 990 that represents an average of the simulated high resolution images 972 and 982 shown in FIGS. 18 and 19, respectively. Each pixel in the high resolution image 990 is the average of the corresponding pixels in the simulated images 972 and 982. Because the human visual system tends to average temporally, as described above, displaying the quantized sub-frames 30I-2, 30J-2, 30K-2, and 30L-2 using four-position processing, followed by displaying the quantized sub-frames 30M-2, 30N-2, 30O-2, and 30P-2 using four-position processing, will appear to the human visual system as high resolution image 990. Most of the pixels in high resolution image 990 have a value of "3". Thus, the spatio-temporal dithering provides a resulting image that is very close to the desired high resolution image 28 (FIGS. 18 and 19), which consists of all 3's.

As described above, in one embodiment, each sub-frame corresponding to a first of two consecutive frames is quantized by adding an even number (e.g., 0, 2, 4, or 6) to the original pixel values, and each sub-frame corresponding to a second of two consecutive frames is quantized by adding an odd number (e.g., 1, 3, 5, or 7) to the original pixel values. In another embodiment of the present invention, each sub-frame is quantized using an even number for some of the pixels in the sub-frame, and an odd number for the remaining pixels in the sub-frame.

For example, referring again to FIG. 17, for the first frame 962A, the upper-left and lower-right pixels in sub-frames 30I–30L are quantized using even dither values as described above, but the upper-right and the lower-left pixels of these sub-frames are quantized using odd dither values. In one embodiment, the upper-right and lower-left pixels in sub-frame 30I are quantized by adding one (i.e., Equation XI), the upper-right and lower-left pixels in sub-frame 30J are quantized by adding three (i.e., Equation XII), the upper-right and lower-left pixels in sub-frame 30K are quantized by adding five (i.e., Equation XIII), and the upper-right and lower-left pixels in sub-frame 30L are quantized by adding seven (i.e., Equation XIV).

Similarly, for the second frame 962B, the upper-left and lower-right pixels in sub-frames 30M-30P are quantized using odd dither values as described above, but the upper-right and the lower-left pixels of these sub-frames are quantized using even dither values. In one embodiment, the upper-right and lower-left pixels in sub-frame 30M are quantized by adding zero (i.e., Equation VII), the upper-right and lower-left pixels in sub-frame 30N are quantized by adding two (i.e., Equation VIII), the upper-right and lower-left pixels in sub-frame 30O are quantized by adding four (i.e., Equation IX), and the upper-right and lower-left pixels in sub-frame 30P are quantized by adding six (i.e., Equation X). Alternating odd and even dither values on a single frame in this manner provides a high frequency checkerboard spatial dither.

In one embodiment, spatio-temporal dithering is implemented in display system 10 with a spatio-temporal dither array, $st_i(M,N,T)$. The spatio-temporal array is an M×N×T array of dither values, where "i" is an index for identifying sub-frames, "M" represents the number of spatial rows in the array, "N" represents the number of spatial columns in the array, and "T" represents the number of frames in the array (this is the temporal dimension of the array). The spatio-temporal array is used in generating quantized sub-frame pixel values as shown in the following Equation XV $$x_i'(m, n, t) = \left\lfloor \frac{x_i(m, n, t) + st_i(m \bmod M, n \bmod N, t \bmod T)}{S} \right\rfloor S \quad \text{Equation XV}$$

Where:

i=index for identifying sub-frames;

$x_i(m,n,t)$=value for the original pixel in the $i^{th}$ sub-frame corresponding to the $t^{th}$ frame at row, m, and column, n;

$x'_i(m,n,t)$=quantized value for pixel $x_i(m,n,t)$;

$S=2^{(B1-B2)}$;

B1=Number of bits in the sub-frames before quantization;

B2=Number of bits in the sub-frames after quantization; and $st_i$=spatio-temporal array having values between 0 and S−1.

As shown by the above Equation XV, the quantized pixel value ($x'_i$) at row m and column n for the current sub-frame under consideration (i.e., the $i^{th}$ sub-frame corresponding to the $t^{th}$ frame) equals the result of the floor operation multiplied by the value S. The floor operation is performed on the result of the sum of the original pixel value at row m and column n for the current sub-frame under consideration and the value from the spatio-temporal array ($st_i$) at array location (m mod M, n mod N, t mod T), divided by the value S. The result of the operation m mod M is the remainder of m divided by M. Likewise, the results of the operations n mod N and t mod T are the remainders of n divided by N and t divided by T, respectively. The operations m mod M, n mod N, and t mod T, result in a tiling of the spatio-temporal array across the image. The quantization represented by Equation XV reduces the bit-depth of the sub-frames from B1 bits to B2 bits.

If the quantized pixel value, $x'_i(m,n,t)$, determined from Equation XV, is greater than the value, $\text{floor}((2^{B1}-1)/S)*S$, then the quantized pixel value is determined from the following Equation XVI, rather than the above Equation XV:

$$x'_i(m,n,t)=\left\lfloor\frac{2^{B1}-1}{S}\right\rfloor S \qquad \text{Equation XVI}$$

The above Equation XVI clips values that are beyond the B2 bit range.

The spatio-temporal array will now be described in further detail in the context of some examples. Assuming that M=N=1, T=2, and a bit-depth reduction from B1=8 bits to B2=6 bits is desired, S will have a value of $2^{(8-6)}=4$. The spatio-temporal array, $st_i(M,N,T)$, has values that range from 0 to S−1 (i.e., 0 to 3). With B1=8 bits, the un-quantized pixels, $x_i(m,n,t)$, will have possible values ranging from 0 to 255. The quantized pixels, $x'_i(m,n,t)$, obtained from Equation XV above, will have possible values of 0, 4, 8, 12, . . . , 256. Based on the above values, the maximum quantized pixel value is given by the following Equation XVII:

$$x'_i(m,n,t)=\text{floor}((255+3)/4)*4=256 \qquad \text{Equation XVII}$$

Since the maximum quantized pixel value (i.e., 256) is greater than $\text{floor}((2^{B1}-1)/S)*S$, the maximum quantized pixel value is clipped by Equation XVI to 252. Thus, the quantized pixels have possible values of 0, 4, 8, 12, . . . , 252.

For two-position processing according to one embodiment, such as described above with reference to FIG. 13, M=N=1, and T=2, and the spatio-temporal array has dither values given by the following Equations XVIII–XXI:

$$st_A(0,0,0)=0 \qquad \text{Equation XVIII}$$

$$st_A(0,0,1)=1 \qquad \text{Equation XIX}$$

$$st_B(0,0,0)=2 \qquad \text{Equation XX}$$

$$st_B(0,0,1)=3 \qquad \text{Equation XXI}$$

For two-position processing according to one embodiment, two sub-frames (e.g., sub-frame A, and sub-frame B) are generated for each frame. Thus, in the above Equations XVIII–XXI, the index, i, for the spatio-temporal array, $st_i(m,n,t)$, is replaced by the letters A and B.

For four-position processing according to one embodiment, such as described above with reference to FIG. 17, M=N=1, and T=2, and the spatio-temporal array has dither values given by the following Equations XXII–XXIX:

$$st_A(0,0,0)=0 \qquad \text{Equation XXII}$$

$$st_A(0,0,1)=1 \qquad \text{Equation XXIII}$$

$$st_B(0,0,0)=2 \qquad \text{Equation XXIV}$$

$$st_B(0,0,1)=3 \qquad \text{Equation XXV}$$

$$st_C(0,0,0)=4 \qquad \text{Equation XXVI}$$

$$st_C(0,0,1)=5 \qquad \text{Equation XXVII}$$

$$st_D(0,0,0)=6 \qquad \text{Equation XXVIII}$$

$$st_D(0,0,1)=7 \qquad \text{Equation XXIX}$$

For four-position processing according to one embodiment, four sub-frames (e.g., sub-frame A, sub-frame B, sub-frame C, and sub-frame D) are generated for each frame. Thus, in the above Equations XXII–XXIX, the index, i, for the spatio-temporal array, $st_i(m,n,t)$, is replaced by the letters A, B, C, and D.

For four-position processing with alternating "checkerboard" dither according to one embodiment, M=N=2, and T=2, and the spatio-temporal array has dither values given by the following Equations XXX–XLV:

$$st_A(0,0,0)=0 \qquad \text{Equation XXX}$$

$$st_A(0,0,1)=1 \qquad \text{Equation XXXI}$$

$$st_A(0,1,0)=1 \qquad \text{Equation XXXII}$$

$$st_A(0,1,1)=0 \qquad \text{Equation XXXIII}$$

$$st_B(0,0,0)=2 \qquad \text{Equation XXXIII}$$

$$st_B(0,0,1)=3 \qquad \text{Equation XXXV}$$

$$st_B(0,1,0)=3 \qquad \text{Equation XXXVI}$$

$$st_B(0,1,1)=2 \qquad \text{Equation XXXVII}$$

$$st_C(0,0,0)=4 \qquad \text{Equation XXXVIII}$$

$$st_C(0,0,1)=5 \qquad \text{Equation XXXIX}$$

$$st_C(0,1,0)=5 \qquad \text{Equation XL}$$

$$st_C(0,1,1)=4 \qquad \text{Equation XLI}$$

$$st_D(0,0,0)=6 \qquad \text{Equation XLII}$$

$$st_D(0,0,1)=7 \qquad \text{Equation XLIII}$$

$$st_D(0,1,0)=7 \qquad \text{Equation XLIV}$$

$$st_D(0,1,1)=6 \qquad \text{Equation XLV}$$

For four-position processing with alternating "checkerboard" dither according to one embodiment, four sub-frames (e.g., sub-frame A, sub-frame B, sub-frame C, and sub-frame D) are generated for each frame. Thus, in the above Equations XXX–XLV, the index, i, for the spatio-temporal array, $st_i(m,n,t)$, is replaced by the letters A, B, C, and D.

In one embodiment, the spatio-temporal array, $st_i(M,N,T)$, is designed using a human visual system (HVS) filter. One embodiment of such a design will now be described. An empty spatio-temporal array is randomly filled with equal numbers of 0, 1, 2, . . . , S−1 values. Sub-frames are generated for a set of test image sequences. The sub-frames are dithered with the existing spatio-temporal array (i.e., the array with the random values) to produce dithered sub-frames. A simulated high resolution image is computed from the dithered sub-frames. The error between the simulated high resolution image and the actual high resolution image sequence is computed. The computed error is weighted based on an HVS model. In one embodiment, the HVS model is applied by filtering the error with a linear filter. The weighted error is averaged to compute a single number as an error measure. The spatio-temporal array values are swapped (e.g., a 1 at location (1,0,1) is exchanged with a 3 at location (0,0,1)), and the error is recomputed. Several iterations of swapping values may be performed to further reduce the weighted average error. After the iteration limit is reached, the array configuration that results in the smallest average error measure is retained.

One form of the present invention provides a display system 10 configured to perform two-position or four-position processing, and spatio-temporal dithering to reduce or eliminate contouring artifacts in the displayed image associated with a limited bit-depth. In one embodiment, the spatio-temporal dither is specifically designed for systems that perform spatial and temporal shifting of sub-frames, such as in two-position or four-position processing. One form of the spatio-temporal dither is based on a mathematical model of N-position processing, where N is two or four in the embodiments described above, but could have a different value for other embodiments. Methods which do not consider this model may be suboptimal. One form of the invention provides a way for two-position or four-position processing to work in a practical system where the bit-depth is constrained due to the limited time-slot per color and the switching speed of the DMD array. In one embodiment, a dither pattern is spread temporally across the sub-frames for two frames, and is then repeated. In another embodiment, the dither pattern is spread temporally across the sub-frames for more than two frames before being repeated.

Using spatio-temporal dithering according to one embodiment of the present invention, a display system 10 configured to perform two-position processing and constrained to 6-bits per color can produce results perceptually equivalent to display system with a higher resolution DMD array with 8-bits per color. In contrast, the same display system suffers from severe contouring if uniform quantization is used to produce 6-bits per color.

Techniques have been proposed for reducing contouring in display systems. For example, U.S. Pat. No. 5,751,379 (the '379 patent) discloses a method of reducing perceptual contouring in display systems. However, the system disclosed in the '379 patent does not perform temporal and spatial shifting of sub-frames (e.g., does not perform two-position processing or four-position processing as described above), and does not take a mathematical model of such processing into account in designing the dither. The '379 patent discloses that an additional LSB is displayed every other frame. This display of an additional LSB complicates the timing circuits. The approach disclosed in the '379 patent is also based on temporal dither, and does not incorporate joint spatio-temporal dither.

Using existing dither techniques would not produce the same benefits provided by the spatio-temporal dithering according to one embodiment, because such existing dither techniques do not take into account N-position processing, and do not involve jointly quantizing multiple sub-frames.

Although specific embodiments have been illustrated and described herein for purposes of description of the preferred embodiment, it will be appreciated by those of ordinary skill in the art that a wide variety of alternate or equivalent implementations may be substituted for the specific embodiments shown and described without departing from the scope of the present invention. Those with skill in the mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of displaying an image with a display device, the method comprising:

receiving a first set of image data for a first image;

generating a first sub-frame and a second sub-frame corresponding to the first set of image data;

reducing a bit-depth of the first and the second sub-frames differently based on different quantization equations in a first set of quantization equations, thereby generating a first dithered sub-frame and a second dithered sub-frame; and alternating between displaying the first dithered sub-frame in a first position and displaying the second dithered sub-frame in a second position spatially offset from the first position.

2. The method of claim 1, wherein the first set of quantization equations includes two different quantization equations.

3. The method of claim 2, wherein the bit-depth of the first sub-frame is reduced based on a first of the two quantization equations, and the bit-depth of the second sub-frame is reduced based on a second of the two quantization equations.

4. The method of claim 1, wherein the first set of quantization equations includes four different quantization equations.

5. The method of claim 4, wherein the bit-depth of the first sub-frame is reduced based on first and second ones of the four quantization equations, and the bit-depth of the second sub-frame is reduced based on third and fourth ones of the four quantization equations.

6. The method of claim 1, and further comprising:

generating a third sub-frame and a fourth sub-frame corresponding to the first set of image data;

reducing a bit-depth of the third and the fourth sub-frames based on the first set of quantization equations, thereby generating a third dithered sub-frame and a fourth dithered sub-frame; and wherein alternating between displaying the first dithered sub-frame and displaying the second dithered sub-frame further includes alternating between displaying the first dithered sub-frame in the first position, displaying the second dithered sub-frame in the second position, displaying the third dithered sub-frame in a third position spatially offset from the first position and the second position, and displaying the fourth dithered sub-frame in a fourth position spatially offset from the first position, the second position, and the third position.

7. The method of claim 1, and further comprising:

receiving a second set of image data for a second image;

generating a third sub-frame and a fourth sub-frame corresponding to the second set of image data;

reducing a bit-depth of the third and the fourth sub-frames based on a second set of quantization equations, thereby generating a third dithered sub-frame and a fourth dithered sub-frame; and alternating between displaying the third dithered sub-frame in the first position and displaying the fourth dithered sub-frame in the second position.

8. The method of claim 7, wherein the first and the second images are consecutive images.

9. The method of claim 7, wherein the first and the second sets of quantization equations each include two different quantization equations, and wherein the two quantization equations in the first set are different than the two quantization equations in the second set.

10. The method of claim 9, wherein the bit-depth of the third sub-frame is reduced based on a first of the two quantization equations in the second set, and the bit-depth of the fourth sub-frame is reduced based on a second of the two quantization equations in the second set.

11. The method of claim 7, wherein the first and the second sets of quantization equations each include four different quantization equations, and wherein the four quantization equations in the first set are different than the four quantization equations in the second set.

12. The method of claim 11, wherein the bit-depth of the third sub-frame is reduced based on first and second ones of the four quantization equations in the second set, and the bit-depth of the fourth sub-frame is reduced based on third and fourth ones of the four quantization equations in the second set.

13. The method of claim 1, wherein the step of reducing a bit-depth is performed using at least one array of dither values, the method further comprising:

identifying a dither value from the at least one array for each pixel in the first and the second sub-frames based on a spatial location of the pixel and a temporal location of the sub-frame containing the pixel; and reducing a bit-depth of each pixel in the first and the second sub-frames based on the identified dither value for the pixel.

14. The method of claim 13, wherein the at least one array of dither values is configured based on minimization of an error between a test sequence of high resolution images and simulated high resolution images generated from dithered sub-frames.

15. The method of claim 14, wherein the error is weighted based on characteristics of a human visual system.

16. A system for displaying an image, the system comprising:

a buffer adapted to receive a first set of image data for a first image;

an image processing unit configured to define first and second sub-frames corresponding to the first set of image data, and generate corresponding first and second dithered sub-frames by quantizing pixel values of the first sub-frame using a first set of dither values, and quantizing pixel values of the second sub-frame using a second set of dither values; and a display device adapted to alternately display the first dithered sub-frame in a first position and the second dithered sub-frame in a second position spatially offset from the first position.

17. The system of claim 16, wherein the first and second sets of dither values each include a single dither value.

18. The system of claim 16, wherein the first and second sets of dither values each include at least two dither values.

19. The system of claim 16, wherein each pixel value is quantized by dividing a sum of the pixel value and a dither value by a first value, taking a floor of the result of the division, and multiplying the result of the floor by the first value.

20. The system of claim 16, wherein the buffer is adapted to receive a second set of image data for a second image, and the image processing unit is configured to define a third sub-frame and a fourth sub-frame corresponding to the second set of image data, and generate corresponding third and fourth dithered sub-frames by quantizing pixel values of the third sub-frame using a third set of dither values, and quantizing pixel values of the fourth sub-frame using a fourth set of dither values.

21. The system of claim 20, wherein the display device is adapted to alternately display the third dithered sub-frame in the first position and the fourth dithered sub-frame in the second position.

22. A system for generating low resolution dithered sub-frames for display at spatially offset positions to generate the appearance of a high resolution image, the system comprising:

means for receiving image data for a plurality of high resolution images;

means for generating a plurality of sets of low resolution sub-frames based on the image data, each set of low resolution sub-frames corresponding to one of the high resolution images; and means for spatially and temporally dithering the plurality of sets of low resolution sub-frames to generate a corresponding plurality of sets of low resolution dithered sub-frames.

23. The system of claim 22, wherein the plurality of high resolution images includes first and second sets of high resolution images, and wherein the means for spatially and temporally dithering comprises:

means for quantizing each set of sub-frames corresponding to high resolution images in the first set based on a plurality of even dither values, and quantizing each set of sub-frames corresponding to high resolution images in the second set based on a plurality of odd dither values.

24. A computer-readable medium having computer-executable instructions for performing a method of generating low resolution dithered sub-frames for display at spatially offset positions to generate the appearance of a high resolution image, comprising:

receiving image data for first and second sets of high resolution images;

generating a plurality of sets of low resolution sub-frames based on the image data, each set of sub-frames corresponding to one of the high resolution images;

quantizing each set of sub-frames corresponding to high resolution images in the first set based on a first plurality of dither values;

quantizing each set of sub-frames corresponding to high resolution images in the second set based on a second plurality of dither values that is different than the first plurality of dither values; and wherein the quantizing steps provides a spatial and temporal dither of the sub-frames.

* * * * *

UNITED STATES PATENT AND TRADEMARK OFFICE

CERTIFICATE OF CORRECTION

PATENT NO. : 7,190,380 B2
APPLICATION NO. : 10/672845
DATED : March 13, 2007
INVENTOR(S) : Niranjan Damera-Venkata et al.

It is certified that error appears in the above-identified patent and that said Letters Patent is hereby corrected as shown below:

In column 19, line 31, delete "30L-I" and insert -- 30L-1 --, therefor.

Signed and Sealed this

Twenty-seventh Day of October, 2009

David J. Kappos

David J. Kappos
*Director of the United States Patent and Trademark Office*